US010981413B2

(12) United States Patent
Hoshiyama

(10) Patent No.: US 10,981,413 B2
(45) Date of Patent: Apr. 20, 2021

(54) AUTOMATIC CONTINUOUS IMAGE ENGRAVING DEVICE

(71) Applicant: World Venture Corporation, Tokyo (JP)

(72) Inventor: Yuichi Hoshiyama, Tokyo (JP)

(73) Assignee: WORLD VENTURE CORPORATION, Tokyo (JP)

( * ) Notice: Subject to any disclaimer, the term of this patent is extended or adjusted under 35 U.S.C. 154(b) by 298 days.

(21) Appl. No.: 16/312,899

(22) PCT Filed: Jun. 29, 2017

(86) PCT No.: PCT/JP2017/023951
§ 371 (c)(1),
(2) Date: Dec. 21, 2018

(87) PCT Pub. No.: WO2018/003922
PCT Pub. Date: Jan. 4, 2018

(65) Prior Publication Data

US 2019/0322118 A1 Oct. 24, 2019

(30) Foreign Application Priority Data

Jun. 30, 2016 (JP) ..... JP2016-130807
Jun. 30, 2016 (JP) ..... JP2016-130808
(Continued)

(51) Int. Cl.
*B44B 3/00* (2006.01)
*B42D 25/48* (2014.01)
(Continued)

(52) U.S. Cl.
CPC ..... *B42D 25/48* (2014.10); *B42D 25/44* (2014.10); *B44B 3/00* (2013.01); *B44B 3/009* (2013.01); *B42D 25/333* (2014.10)

(58) Field of Classification Search
CPC ..... B42D 25/48; B42D 25/44; B42D 25/333; B42D 25/23; B42D 25/324; B42D 25/43;
(Continued)

(56) References Cited

U.S. PATENT DOCUMENTS 4,972,323 A * 11/1990 Cauwet ..... B44B 3/009 358/3.29
5,232,321 A 8/1993 Suzuki
(Continued)

FOREIGN PATENT DOCUMENTS

EP 0945284 A2 9/1999
JP 63-088831 A 4/1988
(Continued)

*Primary Examiner* — Yaritza Guadalupe-McCall
(74) *Attorney, Agent, or Firm* — Norris McLaughlin, P.A.

(57) ABSTRACT

Provided are an automatic continuous image engraving device capable of decreasing in size of an installing space of the device. The device comprises an unengraved medium accommodating part, an engraved medium accommodating part, a medium dispenser, a medium positioning and conveying part, and an image engraving part, wherein the medium dispenser releases the unengraved card-shaped engraving medium to cause the same to be succeeded at the succeeding position, the medium positioning and conveying part returns the engraved card-shaped engraving medium after image engraving from the engraving position to the succeeding position, and the medium dispenser adsorbs the engraved card-shaped engraving medium at the succeeding position, moves the same upward, travels above the engraved medium accommodating part, and releases the engraved card-shaped engraving medium to be accommodated.

4 Claims, 20 Drawing Sheets

(30) Foreign Application Priority Data

Jun. 30, 2016 (JP) ..... JP2016-130809
Jun. 30, 2016 (JP) ..... JP2016-130810

(51) Int. Cl.
*B42D 25/44* (2014.01)
*B42D 25/333* (2014.01)

(58) Field of Classification Search
CPC ..... B44B 3/009; B44B 3/02; B44B 3/065; B44B 3/007; B44B 3/06
USPC ..... 33/18.1, 32.4
See application file for complete search history.

(56) References Cited

U.S. PATENT DOCUMENTS 5,329,381 A * 7/1994 Payne ..... H04N 1/32561 358/3.29
5,569,003 A * 10/1996 Goldman ..... B23Q 7/10 409/132
6,059,495 A 5/2000 Mueller et al.
8,336,215 B2 * 12/2012 Hoshiyama ..... B44B 3/02 33/32.4
8,468,703 B2 * 6/2013 Hoshiyama ..... B44C 1/225 33/32.4
2010/0260973 A1 * 10/2010 Hoshiyama ..... B42D 25/333 428/156
2012/0029681 A1 * 2/2012 Hoshiyama ..... B42D 25/42 700/117
2019/0322118 A1 * 10/2019 Hoshiyama ..... B44B 3/065

FOREIGN PATENT DOCUMENTS

JP 63-201762 U 12/1988
JP 1-115676 A 5/1989
JP 1-140282 A 6/1989
JP 2-019214 A 1/1990
JP 5-024394 A 2/1993
JP 9-507660 A 8/1997
JP 2001-026321 A 1/2001
JP 2003-312841 A 11/2003
JP 2003-338163 A 11/2003
JP 2004-238171 A 8/2004
JP 4516669 B2 8/2010

* cited by examiner

AUTOMATIC CONTINUOUS IMAGE ENGRAVING DEVICE

FIELD OF THE INVENTION

The present invention relates to an automatic continuous image engraving device to perform image engravings on card-shaped engraving media.

BACKGROUND OF THE INVENTION

Conventionally, devices of engraving an image on a magnetic card or synthetic paper were proposed as Patent literatures 1-3. Each device has a single function to conduct an engraving only and cannot conduct automatic continuous image engravings.

Contrary, the applicant proposed an automatic continuous image engraving device of Patent literature 4.

The automatic continuous image engraving device performs image engravings on cards such as credit cards and is provided with a card magazine, a card dispenser, a read/write unit, a card positioning part, a card mounting table, a card conveying part, an image engraving part, a card accommodating magazine, and a card conveying robot.

The card magazine is capable of accommodating a plurality of rectangular cards that allow read/write of data, and the card dispenser sequentially sends out cards accommodated in the card magazine a card long direction.

The read/write unit receives, in the sending-out direction, the card sent out from the card dispenser, conducts data reading or writing, and sends out the card in the card long direction.

The card positioning part receives and positions, in the sending-out direction, the card sent out from the read/write unit.

The card mounting table is a part to which the card is mounted by movement in a card short direction after the positioning on the card positioning part, and the card conveying part conveys the card mounted on the card mounting table in the card long direction between a mounting position and an image engraving position.

The image engraving part performs image engravings using an engraving stylus according to image signals from a controlling part to the cards conveyed to the image engraving position with the card conveying part.

The card accommodating magazine receives and accommodates the engraved cards, which are conveyed back to the mounting position after the image engravings at the image engraving part, by movement in the card short direction.

The card conveying robot linearly transfers the cards in the card short direction from the card positioning part to the card mounting table and from the card mounting table to the card accommodating magazine.

Accordingly, the image engravings to the cards are continuously and automatically performed.

The conventional automatic continuous image engraving device, however, causes a transfer path in a plane to be elongated and the device to increase in size.

PATENT LITERATURE 1: JP 1101-115676 A
PATENT LITERATURE 2: JP H05-24394 A
PATENT LITERATURE 3: JP S63-201762 U
PATENT LITERATURE 4: JP 4516669 B

SUMMARY OF THE INVENTION

A problem to be solved is that a transfer path in a plane is long and increases in size of an installing space of a device.

The present invention provides an automatic continuous image engraving device, capable of decreasing in size of an installing space of the device, the device comprising an unengraved medium accommodating part that accommodates unengraved card-shaped engraving media vertically stacked, an engraved medium accommodating part that is arranged adjacent to the unengraved medium accommodating part and accommodates engraved card-shaped engraving media, a medium dispenser that adsorbs a highest one of the stacked unengraved card-shaped engraving media from an upper part of the unengraved medium accommodating part, moves the highest one to an outside of a region above the unengraved medium accommodating part and linearly travels in an adjacent direction of the unengraved medium accommodating part and the engraved medium accommodating part, a medium positioning and conveying part arranged in a traveling direction of the medium dispenser and configured to succeed to the unengraved card-shaped engraving medium at a succeeding position, move the unengraved card-shaped engraving medium, and position the unengraved card-shaped engraving medium at an engraving position, an image engraving part arranged at the engraving position to perform image engraving on the unengraved card-shaped engraving medium, wherein the medium dispenser releases the unengraved card-shaped engraving medium to cause the unengraved card-shaped engraving medium to be succeeded at the succeeding position, the medium positioning and conveying part returns the engraved card-shaped engraving medium after image engraving from the engraving position to the succeeding position, and the medium dispenser adsorbs the engraved card-shaped engraving medium at the succeeding position, moves the engraved card-shaped engraving medium upward, travels above the engraved medium accommodating part, and releases the engraved card-shaped engraving medium to be accommodated.

The present invention, because of the aforementioned configuration, can arrange the unengraved medium accommodating part and the engraved medium accommodating part and the medium positioning and conveying part and the image engraving part in line in the linear traveling direction of the medium dispenser, thereby making an installing space of the device compact.

EMBODIMENT FOR CARRYING OUT THE INVENTION

Figure 1:
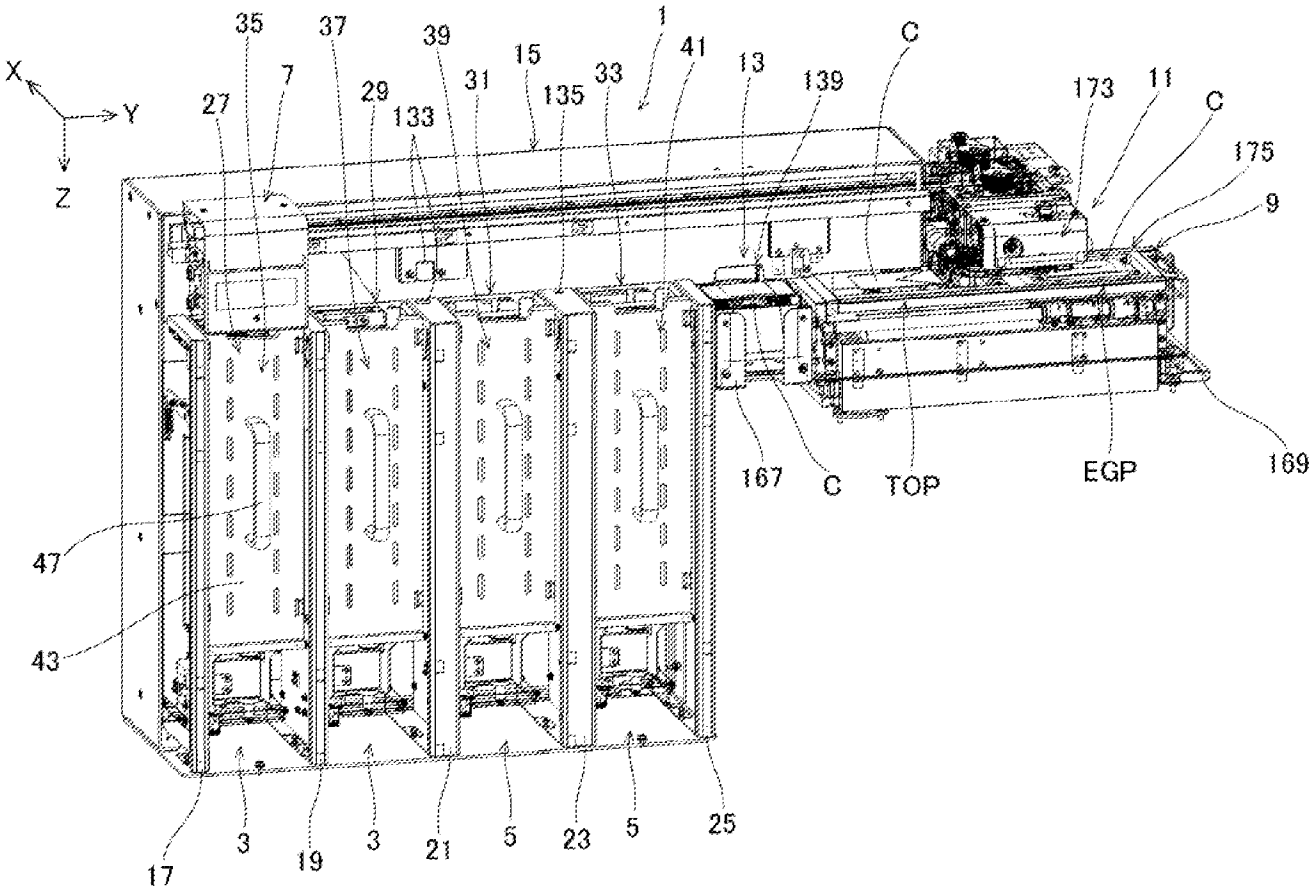
FIG. 1 is a general perspective view illustrating an automatic continuous image engraving device when seen from a front side according to the Embodiment 1 of the present invention.

An object that is capable of decreasing in size of an installing space of a device is accomplished by comprising an unengraved medium accommodating part that accommodates unengraved card-shaped engraving media vertically stacked, an engraved medium accommodating part that is arranged adjacent to the unengraved medium accommodating part and accommodates engraved card-shaped engraving media, a medium dispenser that adsorbs a highest one of the stacked unengraved card-shaped engraving media from an upper part of the unengraved medium accommodating part, moves the highest one to an outside of a region above the unengraved medium accommodating part and linearly travels in an adjacent direction of the unengraved medium accommodating part and the engraved medium accommodating part, a medium positioning and conveying part arranged in a traveling direction of the medium dispenser and configured to succeed to the unengraved card-shaped engraving medium at a succeeding position, move the unengraved card-shaped engraving medium, and position the unengraved card-shaped engraving medium at an engraving position, an image engraving part arranged at the engraving position to perform image engraving on the unengraved card-shaped engraving medium at the engraving position, wherein the medium dispenser releases the unengraved card-shaped engraving medium to cause the unengraved card-shaped engraving medium to be succeeded at the succeeding position, the medium positioning and conveying part returns the engraved card-shaped engraving medium after image engraving from the engraving position to the succeeding position, and the medium dispenser adsorbs the engraved card-shaped engraving medium at the succeeding position, moves the engraved card-shaped engraving medium upward, travels above the engraved medium accommodating part, and releases the engraved card-shaped engraving medium to be accommodated.

It may be configured that the unengraved medium accommodating part is provided with a table on which the unengraved card-shaped engraving media vertically stacked are put, the table that is vertically driven, the highest one of the unengraved card-shaped engraving media is put to a predetermined vertical position by vertically driving of the table, and the medium dispenser adsorbs the highest unengraved card-shaped engraving medium at the predetermined vertical position.

It may be configured that the automatic continuous image engraving device further comprises a pre-positioning part provided between the medium positioning and conveying part and the unengraved medium accommodating part and the engraved medium accommodating part to pre-position an unengraved card-shaped engraving medium, wherein the medium dispenser positions the unengraved card-shaped engraving medium at the pre-positioning part and then causes the medium positioning and conveying part to succeed to the unengraved card-shaped engraving medium at the succeeding position, and moves an engraved card-shaped engraving medium at the succeeding position above the engraved medium accommodating part during the unengraved card-shaped engraving medium is positioned at the pre-positioning part.

Further, the conventional automatic continuous image engraving device tends to be insufficient in positioning of a card and limits on accurate image engraving.

For this case, an object that is capable of accurately positioning is accomplished by comprising a belt that causes an unengraved card-shaped engraving medium to be transferred and put thereon and runs in a positioning direction and a discharging direction according to selectively normally or reversely driving of a positioning motor to move the card-shaped engraving medium, a positioning body that is provided on the positioning direction side of the belt and causes the card-shaped engraving medium to be brought into contact therewith and be positioned thereto according to movement of the card-shaped engraving medium in the positioning direction, and a discharging receptacle that is provided on the discharging direction side of the belt and accepts discharging of the card-shaped engraving medium according to movement of the card-shaped engraving medium in the discharging direction.

The positioning body may be provided with a position changing mechanism that is positionally changeably supported with the belt in a running direction of the belt so as to change a position of the positioning body by driving of a changing motor.

It may be provided with a medium conveying part that is traveled and guided with a guide rail orthogonal to the running direction of the belt, conveys the unengraved card-shaped engraving medium via adsorption to conduct the transferring and adsorbs and send out a card-shaped engraving medium after the positioning.

Accordingly, the unengraved card-shaped engraving medium transferred on the belt is brought into contact with the positioning body by the running of the belt according to the driving of the positioning motor, to be easily positioned. If there are deficiencies in the unengraved card-shaped engraving medium transferred on the belt, the card-shaped engraving medium is discharged to the discharging receptacle by the running of the belt according to the reversely driving of the positioning motor. The accurate image engraving is, therefore, realized.

Further, in the conventional automatic continuous image engraving device, the card or cards are conveyed to the image engraving part and is subjected to the image engraving even if two cards are put one on another or a face to be engraved is reversed, and therefore there is a problem that the inaccurate image engraving is wastefully performed.

With this regard, a sensor to detect normality or abnormality may be attached. If the sensor is simply attached, however, a detecting space has to be provided and there is a problem that it is hard to secure both suppression of increasing in size of the device and accurate image engraving.

For this case, an object that is capable of securing suppression of increasing in size of the device and accurate image engraving is accomplished by comprising an unengraved medium accommodating part that accommodates unengraved card-shaped engraving media vertically stacked, an engraved medium accommodating part that is arranged adjacent to the unengraved medium accommodating part and accommodates engraved card-shaped engraving media, a medium dispenser that adsorbs a highest one of the stacked unengraved card-shaped engraving media from an upper part of the unengraved medium accommodating part, moves the highest one to an outside of a region above the unengraved medium accommodating part and linearly travels in an adjacent direction of the unengraved medium accommodating part and the engraved medium accommodating part, a medium positioning and conveying part arranged in a traveling direction of the medium dispenser and configured to succeed to the unengraved card-shaped engraving medium at a succeeding position, move the unengraved card-shaped engraving medium, and position the unengraved card-shaped engraving medium at an engraving position, an image engraving part arranged at the engraving position and performs an image engraving on the unengraved card-shaped engraving medium at the engraving position, wherein a sensor that detects normality or abnormality of an unengraved card-shaped engraving medium being moved by the medium dispenser is arranged between the unengraved medium accommodating part and the engraved medium accommodating part, and a medium discharging part is provided to perform discharging control if the sensor detects the abnormality of the card-shaped engraving medium.

The sensor may be configured to detect a single sheet of the unengraved card-shaped engraving medium being moved by the medium dispenser as normality, or detect normality in a front and back of the unengraved card-shaped engraving medium being moved by the medium dispenser.

It may comprise an unengraved medium accommodating part that accommodates unengraved card-shaped engraving media vertically stacked, an engraved medium accommodating part that is arranged adjacent to the unengraved medium accommodating part and accommodates engraved card-shaped engraving media, a medium dispenser that adsorbs a highest one of the stacked unengraved card-shaped engraving media from an upper part of the unengraved medium accommodating part, moves the highest one to an outside of a region above the unengraved medium accommodating part and linearly travels in an adjacent direction of the unengraved medium accommodating part and the engraved medium accommodating part, a medium positioning and conveying part arranged in a traveling direction of the medium dispenser and configured to succeed to the unengraved card-shaped engraving medium at a succeeding position, move the unengraved card-shaped engraving medium, and position the unengraved card-shaped engraving medium at an engraving position, an image engraving part arranged at the engraving position to perform an image engraving on the unengraved card-shaped engraving medium at the engraving position, wherein the unengraved medium accommodating part and the engraved medium accommodating part are continuously arranged a plurality of ones in the traveling direction of the medium dispenser, respectively, a first sensor and a second sensor that detect normality and abnormality of the unengraved card-shaped engraving medium being moved by the medium dispenser are arranged between the unengraved medium accommodating part and the engraved medium accommodating part and between the unengraved medium accommodating parts or the engraved medium accommodating parts, respectively, or a first sensor and a second sensor that detect normality and abnormality of the unengraved card-shaped engraving medium being moved by the medium dispenser are arranged between the unengraved medium accommodating parts or the engraved medium accommodating parts, respectively, or a first sensor and a second sensor that detect normality and abnormality of the unengraved card-shaped engraving medium being moved by the medium dispenser are arranged between the unengraved medium accommodating parts and between the engraved medium accommodating parts, respectively, the first sensor detects a single sheet of the unengraved card-shaped engraving medium being moved by the medium dispenser as normality, the second sensor detects normality in a front and back of the unengraved card-shaped engraving medium being moved by the medium dispenser, and a medium discharging part is provided to perform discharging control when one or both of the first and second sensors detect the abnormality of the card-shaped engraving medium.

Accordingly, mutual interspaces of the unengraved medium accommodating parts and the engraved medium accommodating parts are used to arrange the sensors and the sensors are aligned with the linear traveling direction of the medium dispenser, thereby to arrange the sensors reasonably and be capable of securing suppression of increasing in size of the device and accurate image engraving.

Additionally, the conventional automatic continuous image engraving device is provided separately with a card dispenser that sequentially sends out, in a card long direction, cards accommodated in a card magazine and a card conveying robot conveying the cards, and therefore there is a problem of increasing in size of the device.

Where, the inventor and the like considered that the card conveying robot directly adsorbs and conveys the cards accommodated in the card magazine.

In a case of the directly adsorbing with the card conveying robot, a lower card may be, however, stuck to the adsorbed card and conveyed simultaneously, and this becomes an obstacle for accurate image engraving.

For this case, an object that is capable of decreasing in size of an installing space of the device is accomplished by comprising an unengraved medium accommodating part that accommodates unengraved rectangular card-shaped engraving media vertically stacked, an engraved medium accommodating part that is arranged adjacent to the unengraved medium accommodating part and accommodates engraved card-shaped engraving media, a medium dispenser that adsorbs a highest one of the stacked unengraved card-shaped engraving media from an upper part of the unengraved medium accommodating part, moves the highest one to an outside of a region above the unengraved medium accommodating part and linearly travels in an adjacent direction of the unengraved medium accommodating part and the engraved medium accommodating part, a medium positioning and conveying part arranged on an end side in an adjacent direction of the unengraved medium accommodating part and the engraved medium accommodating part and configured to succeed to the unengraved card-shaped engraving medium at a succeeding position, move the unengraved card-shaped engraving medium, and position the unengraved card-shaped engraving medium at an engraving position, an image engraving part arranged at the engraving position to perform an image engraving on the unengraved card-shaped engraving medium, wherein the medium dispenser is provided with a nozzle injects air to a side of the card-shaped engraving medium to separate a stuck lower card when adsorbing the highest one of the unengraved card-shaped engraving media in the unengraved medium accommodating part.

The air injected by the nozzle may be pulsed.

The nozzle may be arranged on an upper part of the unengraved medium accommodating part.

Accordingly, the medium dispenser combines picking-up and conveying of the unengraved card-shaped engraving medium one by one and this enables compactification of the device and accurate image engraving.

Figure 2:
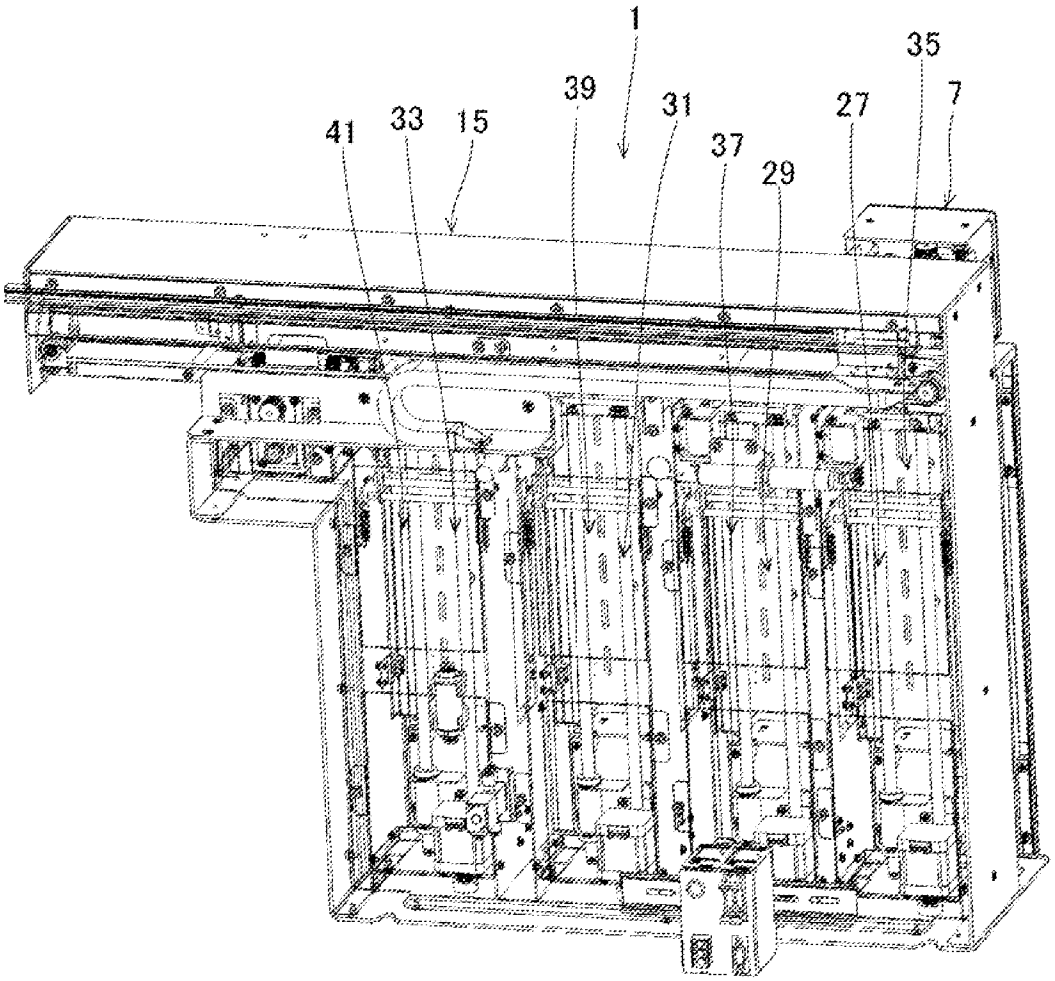
FIG. 2 is a general fragmentary perspective view illustrating the automatic continuous image engraving device when seen from a back side according to the Embodiment 1.

FIG. 1 is a general schematic perspective view illustrating an automatic continuous image engraving device. FIG. 2 is a general fragmentary schematic perspective view illustrating the automatic continuous image engraving device when seen from a back side. It should be noted that, in the following explanation, a Y-direction means a lateral direction in which a card linearly moves and a right-and-left direction when seeing the device from a front. An X-direction means is a direction orthogonal to the Y-direction and a depth direction when seeing the device from the front. A Z-direction means a vertical direction of the device orthogonal to the X- and Y-directions. Front and rear mean front and rear in the Y-direction. Right and left mean right and left in the X-direction and the right and left of the device.

The automatic continuous image engraving device 1 illustrated in FIGS. 1 and 2 is capable of automatically continuously engraving images on card-shaped engraving media without difficulty. The automatic continuous image engraving device 1 is provided with an unengraved medium accommodating part 3 and an engraved medium accommodating part 5, a medium dispenser 7, a medium positioning and conveying part 9, and an image engraving part 11.

The unengraved medium accommodating part 3 and the engraved medium accommodating part 5 according to the present embodiment are formed into the same structure. The unengraved medium accommodating part 3 and the engraved medium accommodating part 5 may be, however, formed into different structures.

The unengraved medium accommodating part 3 is to accommodate unengraved rectangular card-shaped engraving media vertically stacked. The engraved medium accommodating part 5 is to accommodate engraved card-shaped engraving media. According to the present embodiment, two unengraved medium accommodating parts 3 and two engraved medium accommodating parts 5 are provided so that the unengraved medium accommodating parts 3 are arranged in front in the Y-direction and adjacent relative to the engraved medium accommodating parts 5 and the whole is linearly arranged.

The card-shaped medium is formed of plastic, synthetic paper, special synthetic paper or the like into a rectangular planar shape, and is provided with an engraving layer on its top surface that enables an image such as watermark engraved indication to be formed by engraving. Examples of the card-shaped engraving medium are a personal authentication, a credit card and the like. The card-shaped engraving medium may be applied to other different card-shaped media as long as there are necessity and possibility of image engraving. Hereinafter, the card-like engraving medium is simply referred to as a "card".

The medium dispenser 7 is to adsorb a highest one of the unengraved stacked cards from an upper part of the unengraved medium accommodating part 3, move the highest one to an outside of a region above the unengraved medium accommodating part and linearly travel in the Y-direction that is an adjacent direction of the unengraved medium accommodating part 3 and the engraved medium accommodating part 5 to move the card in the Y-direction.

The medium positioning and conveying part 9 is arranged on an end side in the Y-direction that is a linear traveling direction of the medium dispenser 7 and is to succeed to the unengraved card at a succeeding position TOP, move the unengraved card, and position the unengraved card at an engraving position EGP.

The image engraving part 11 is arranged at the engraving position EGP to perform an image engraving on the unengraved card.

Then, the medium dispenser 7 releases the unengraved card to cause the unengraved card to be succeeded at the succeeding position TOP, the medium positioning and conveying part 9 returns an engraved card after the image engraving from the engraving position EGP to the succeeding position TOP, and the medium dispenser 7 adsorbs the engraved card at the succeeding position TOP, moves the engraved card upward, travels above the engraved medium accommodating part 5, and releases the engraved card to be fallen down.

According to the present embodiment, a pre-positioning part 13 is provided between the unengraved medium accommodating part 3 and the engraved medium accommodating part 5 and the medium positioning and conveying part 9 to pre-position the unengraved card.

The medium dispenser 7 positions the unengraved card at the pre-positioning part 13 and then causes the unengraved card to be succeeded to the medium positioning and conveying part 9 at the succeeding position TOP, and moves an engraved card at the succeeding position TOP above the engraved medium accommodating part 5 during the unengraved card is positioned at the pre-positioning part 13.

Where, the structure of each part will be explained in detail.

Figure 3:
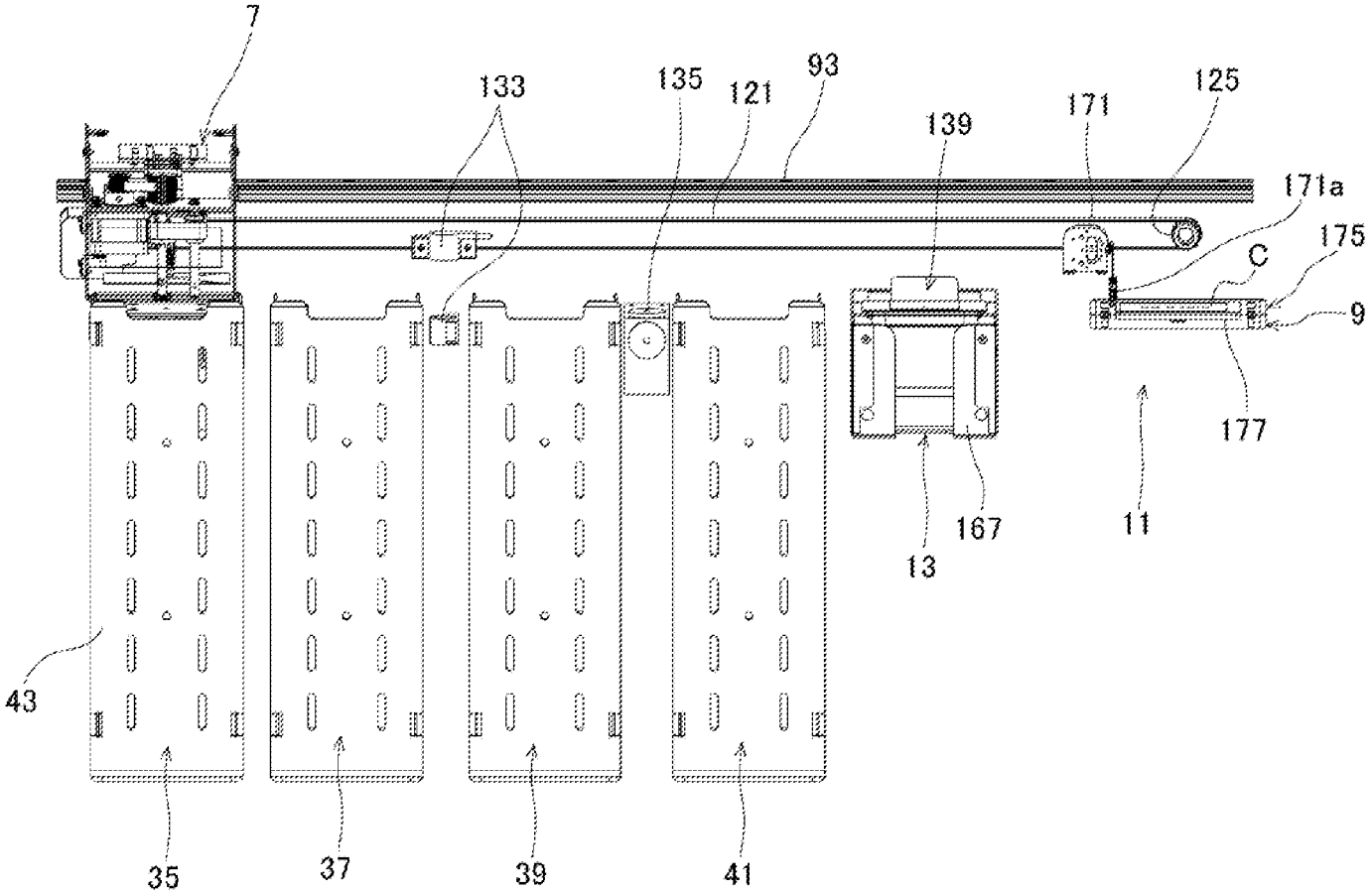
FIG. 3 is a fragmentary front view illustrating a relation among a card cassette, a medium dispenser, a pre-positioning part, a medium positioning and conveying part, and an engraving part according to the Embodiment 1.
Figure 4:
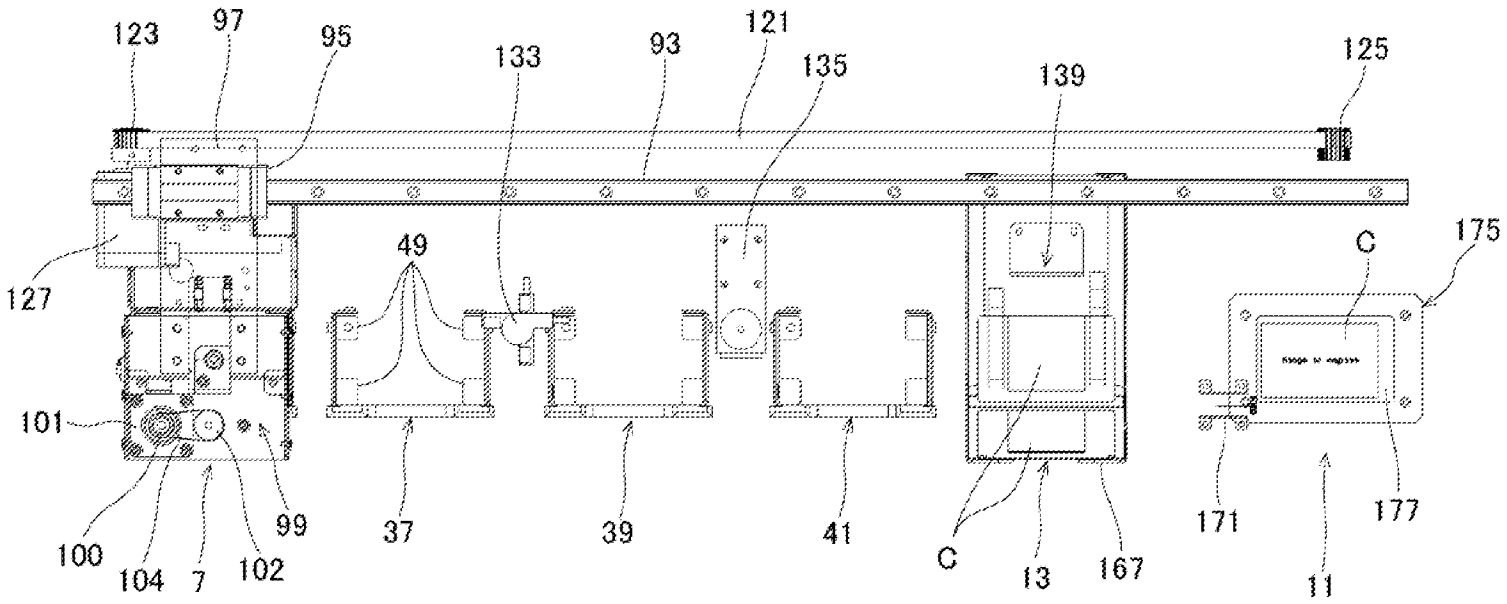
FIG. 4 is a fragmentary plan view illustrating the relation among the card cassette, the medium dispenser, the pre-positioning part, the medium positioning and conveying part, and the engraving part according to the Embodiment 1.
Figure 5:
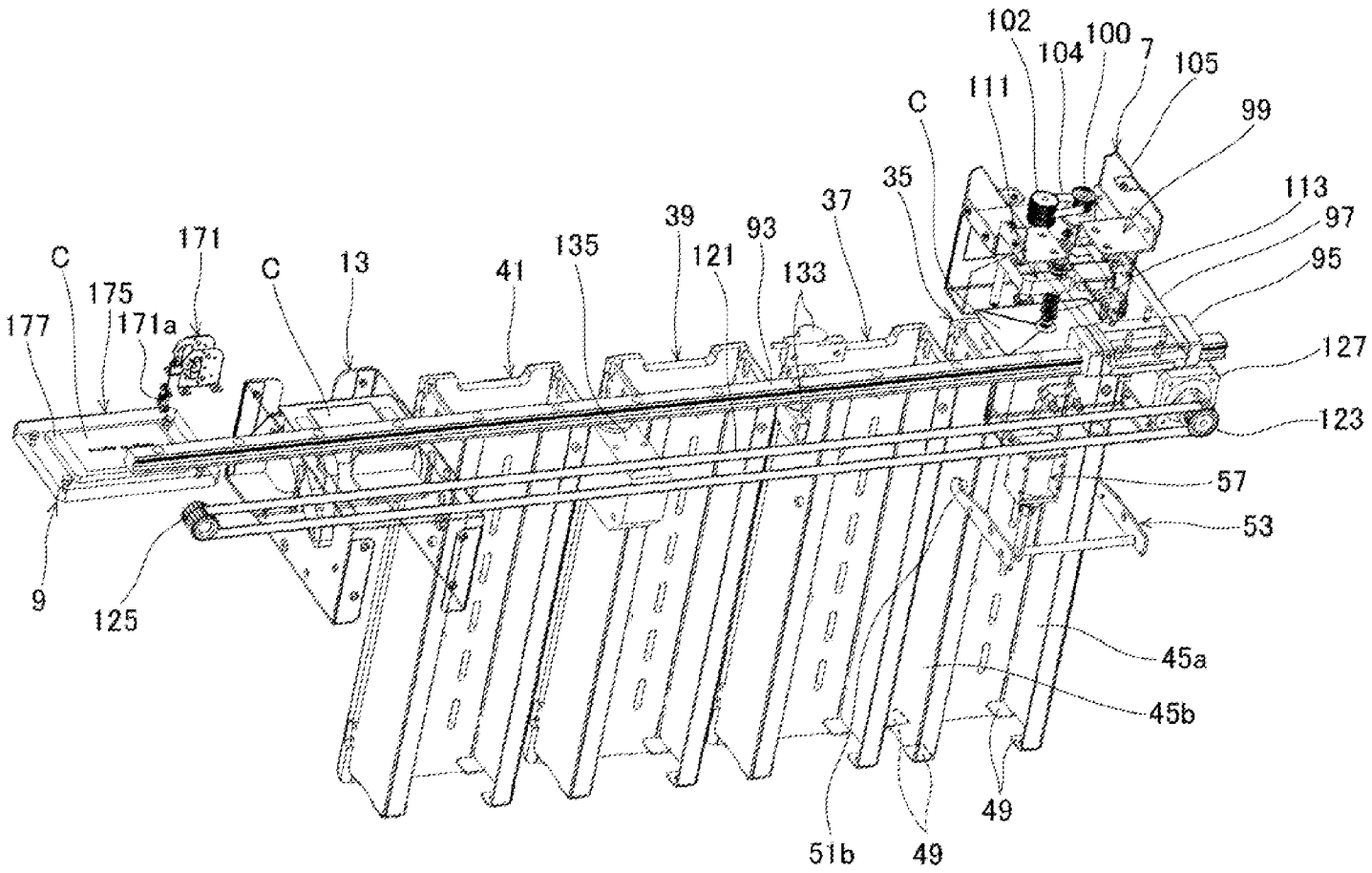
FIG. 5 is a fragmentary perspective view illustrating the relation among the card cassette, the medium dispenser, the pre-positioning part, the medium positioning and conveying part, and the engraving part when seen from the back side according to the Embodiment 1.
Figure 6:
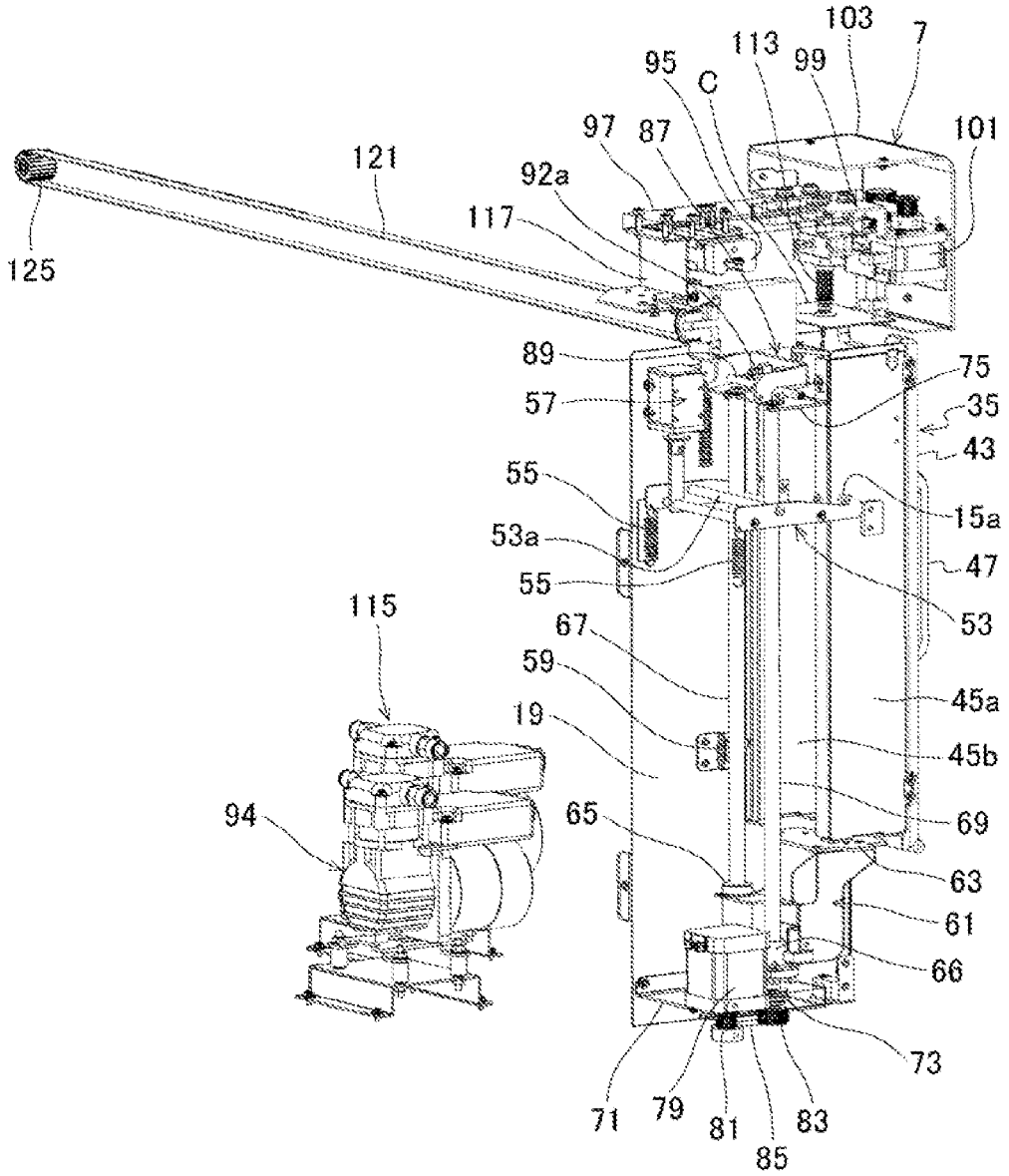
FIG. 6 is a perspective view illustrating a relation between the card cassette and the medium dispenser sectioned with an XZ plane when seen from the back side according to the Embodiment 1.
Figure 7:
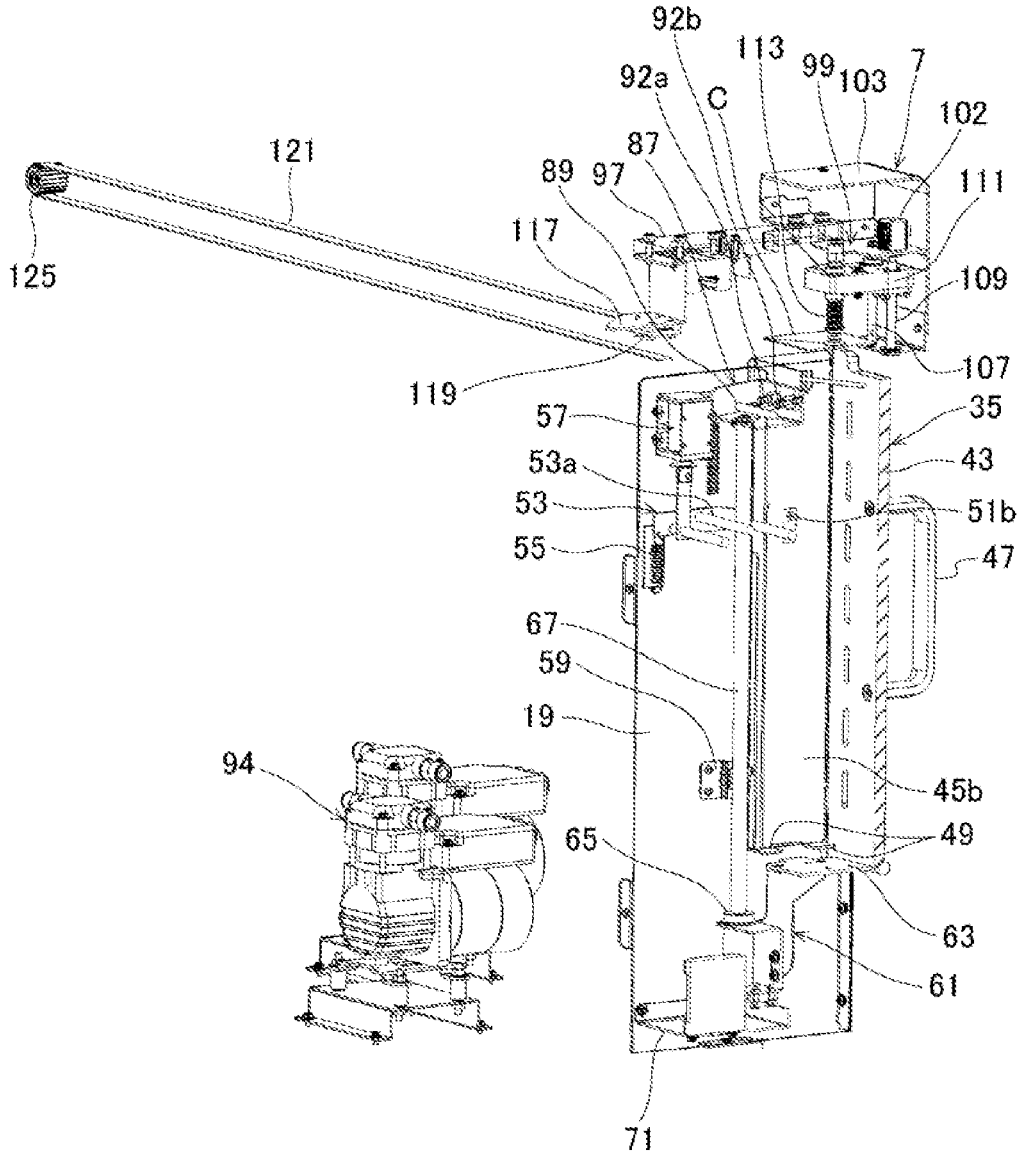
FIG. 7 is a perspective view illustrating the relation between the card cassette and the medium dispenser sectioned with a different XZ plane when seen from the back side according to the Embodiment 1.
Figure 8:
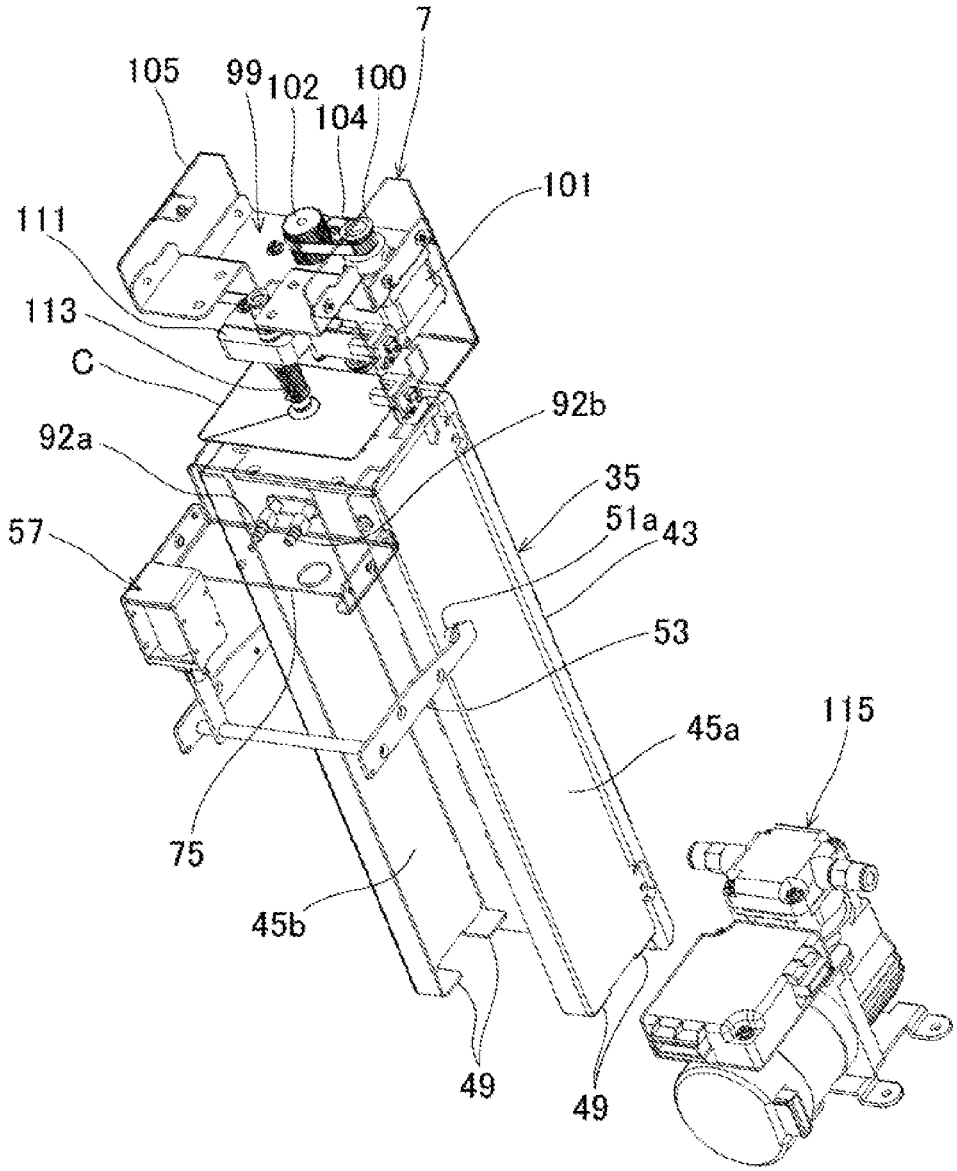
FIG. 8 is a fragmentary perspective view illustrating the relation between the card cassette and the medium dispenser when seen from an upper back side according to the Embodiment 1.
Figure 9:
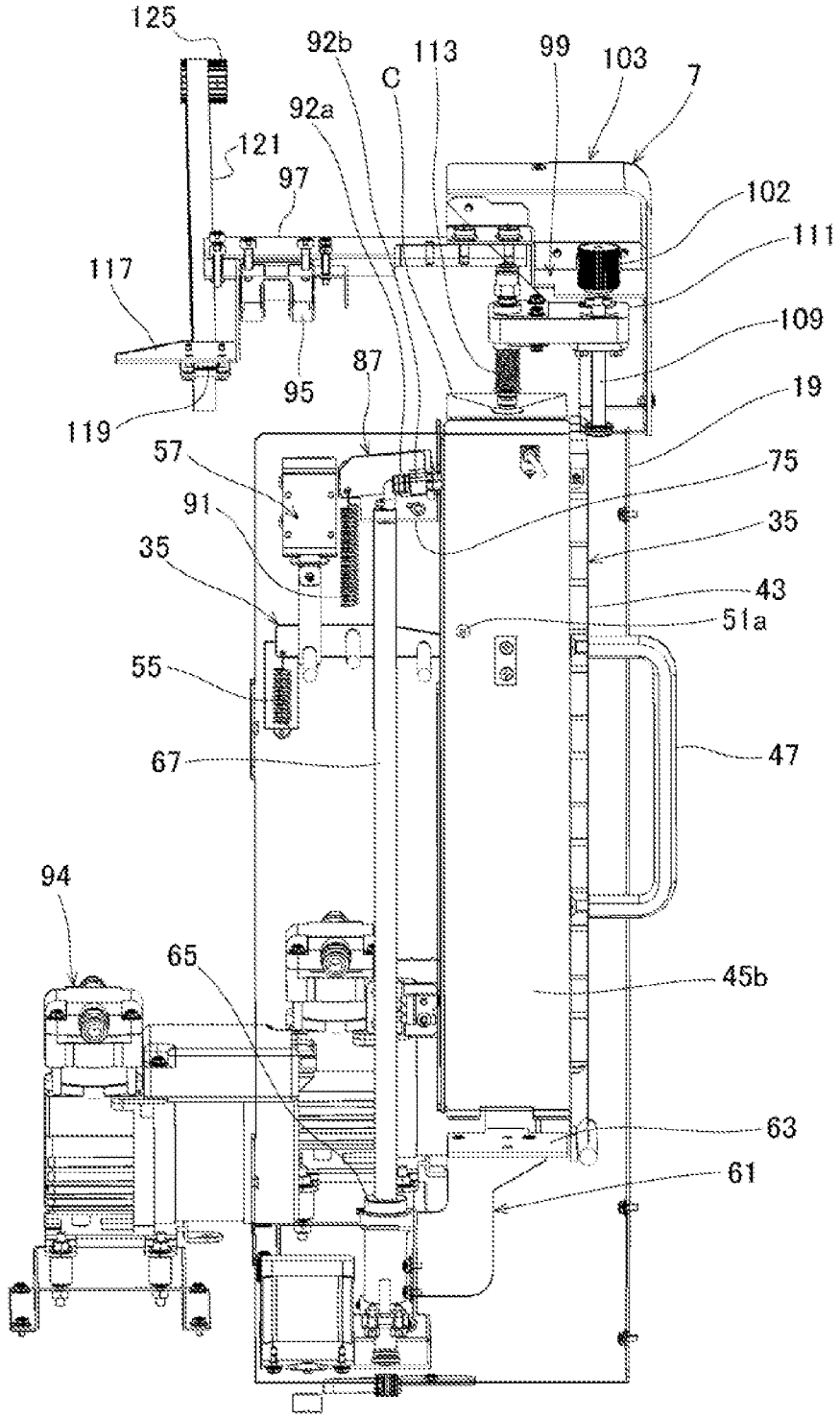
FIG. 9 is a perspective view illustrating the relation between the card cassette and the medium dispenser sectioned with a different XZ plane when seen from an upper lateral side according to the Embodiment 1.
Figure 10:
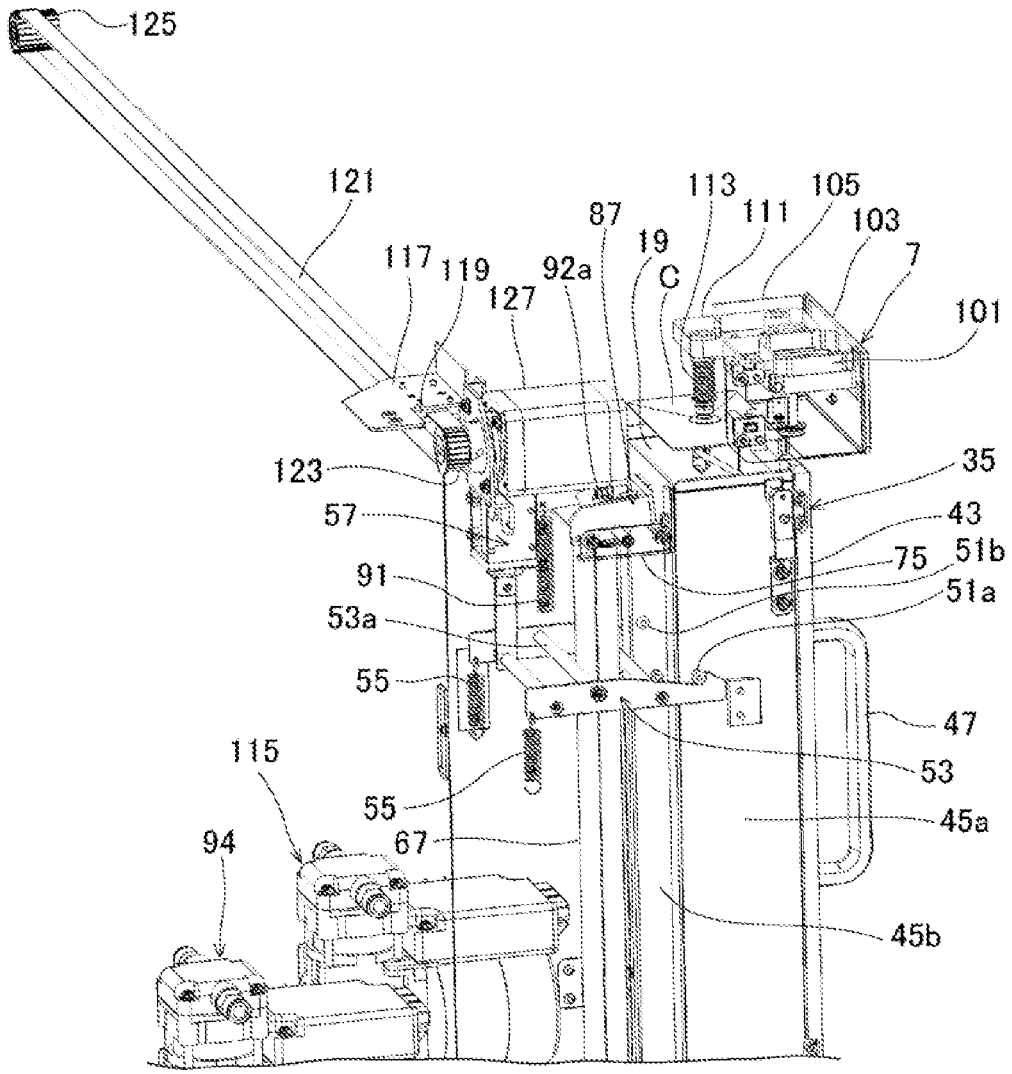
FIG. 10 is a fragmentary perspective view illustrating the relation between the card cassette and the medium dispenser sectioned with a different XZ plane when seen from the back side according to the Embodiment 1.
Figure 11:
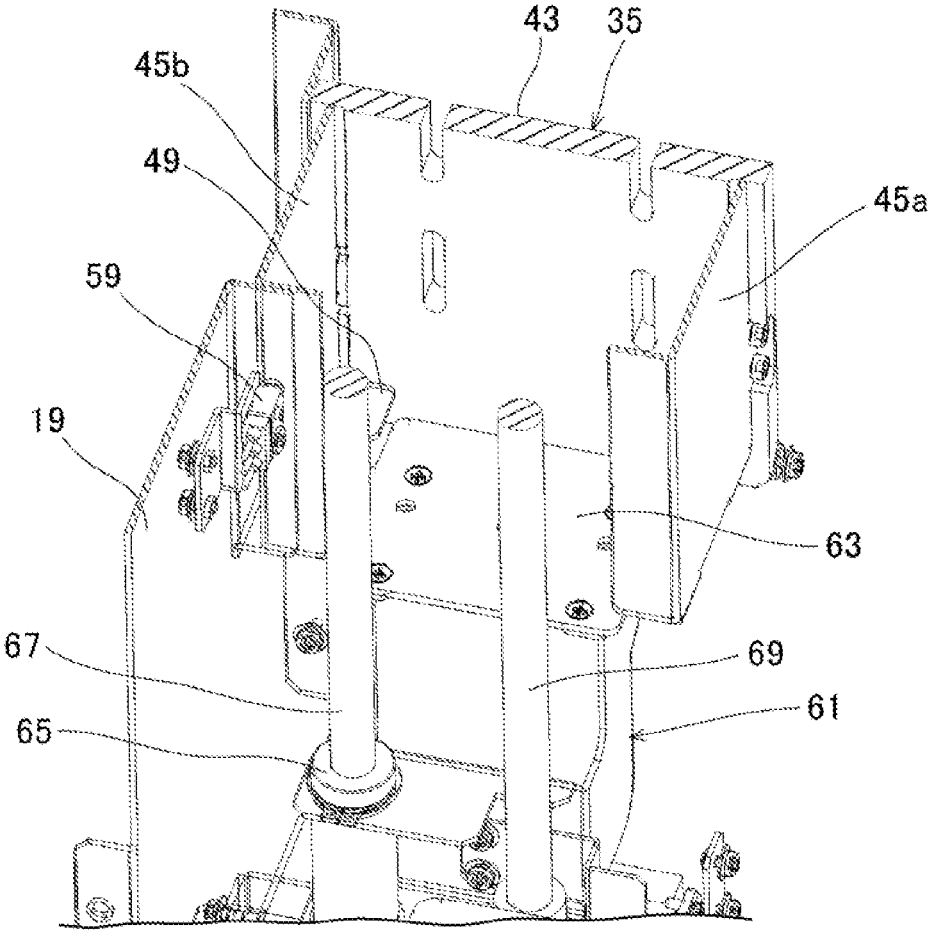
FIG. 11 is a perspective view illustrating a lower side of the card cassette sectioned with an XY plane when seen from the back side according to the Embodiment 1.
Figure 12:
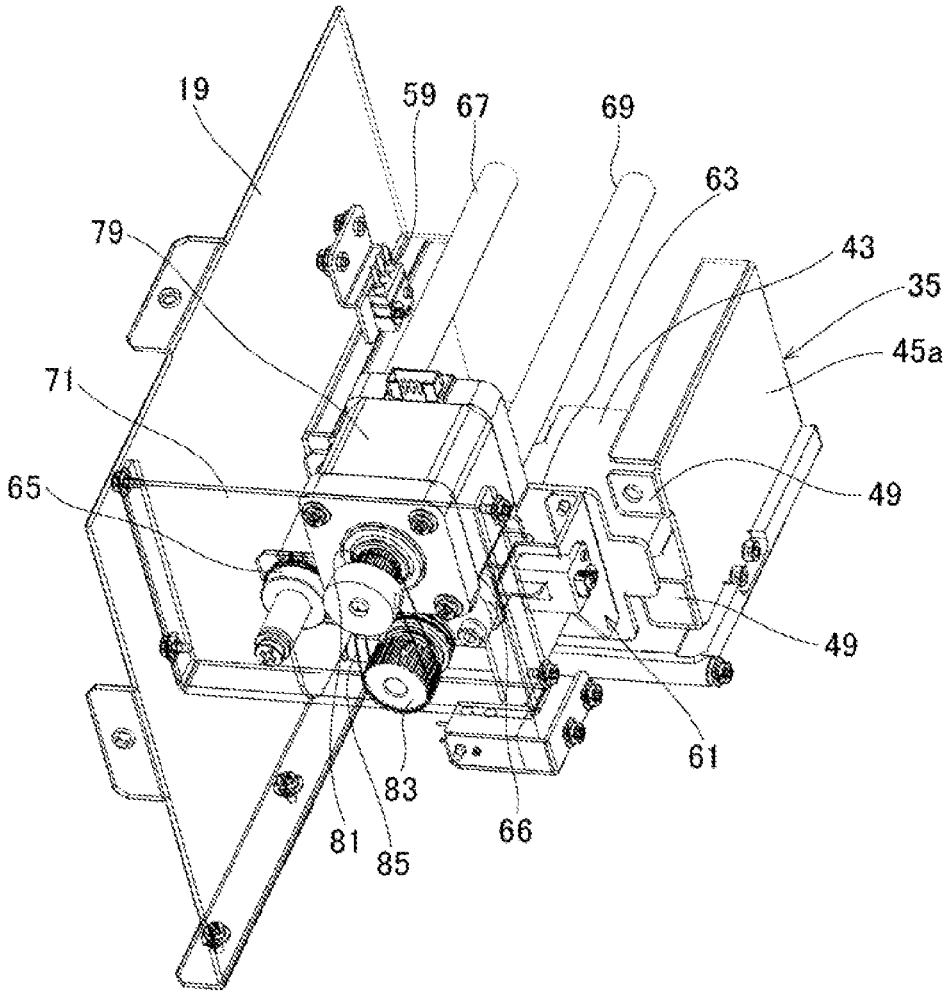
FIG. 12 is a perspective view illustrating the lower side of the card cassette sectioned with the XY plane when seen from a lower back side according to the Embodiment 1.
Figure 13:
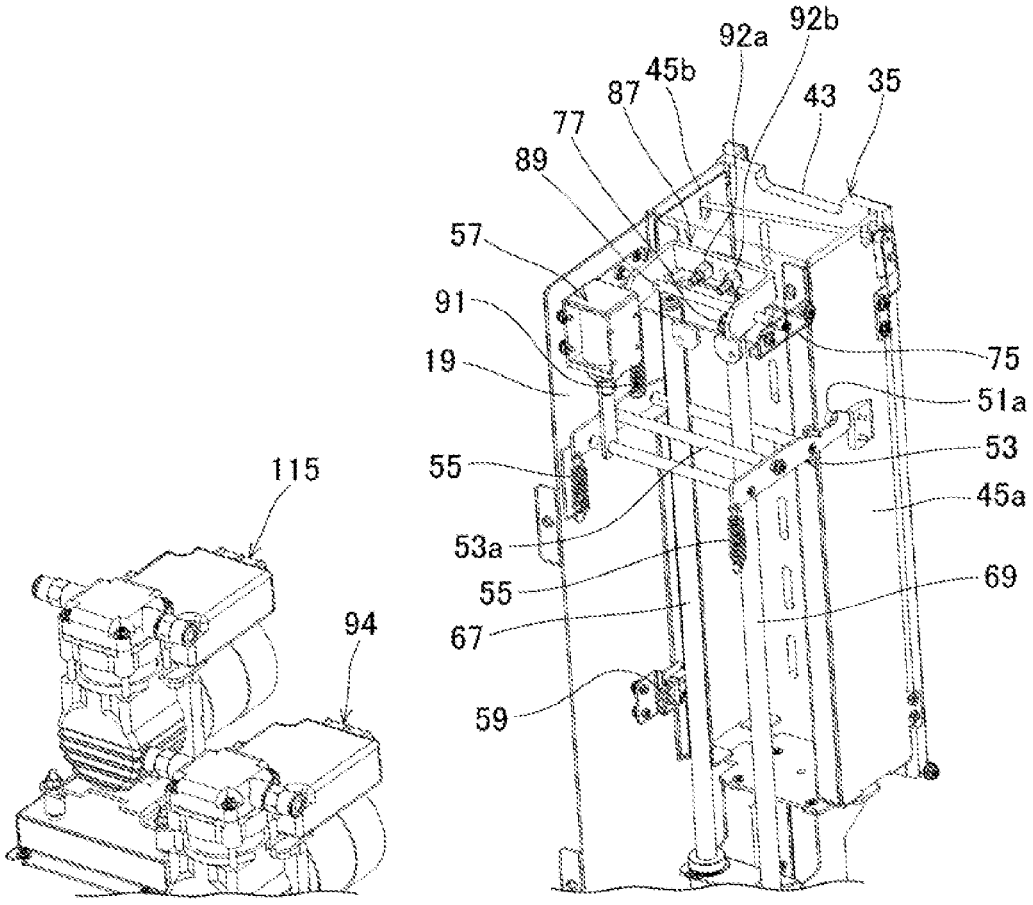
FIG. 13 is a perspective view illustrating an upper part side of the card cassette sectioned with a different XZ plane when seen from an upper back side according to the Embodiment 1.

FIG. 3 is a fragmentary front view illustrating a relation among a card cassette, the medium dispenser, the pre-positioning part, the medium positioning and conveying part, and the engraving part. FIG. 4 is a fragmentary plan view illustrating the relation among the card cassette, the medium dispenser, the pre-positioning part, the medium positioning and conveying part, and the engraving part. FIG. 5 is a fragmentary perspective view illustrating the relation among the card cassette, the medium dispenser, the pre-positioning part, the medium positioning and conveying part, and the engraving part when seen from the back side. FIG. 6 is a perspective view illustrating a relation between the card cassette and the medium dispenser sectioned with an XZ plane when seen from the back side. FIG. 7 is a perspective view illustrating the relation between the card cassette and the medium dispenser sectioned with a different XZ plane when seen from the back side. FIG. 8 is a perspective view illustrating the relation between the card cassette and the medium dispenser when seen from an upper back side. FIG. 9 is a perspective view illustrating the relation between the card cassette and the medium dispenser sectioned with a different XZ plane when seen from an upper lateral side. FIG. 10 is a fragmentary perspective view illustrating the relation between the card cassette and the medium dispenser sectioned with a different XZ plane when seen from the back side. FIG. 11 is a perspective view illustrating a lower side of the card cassette sectioned with an XY plane when seen from the back side. FIG. 12 is a perspective view illustrating the lower side of the card cassette sectioned with the XY plane when seen from a lower back side. FIG. 13 is a perspective view illustrating an upper part side of the card cassette sectioned with a different XZ, plane when seen from an upper back side.

As illustrated in FIGS. 1-13, the unengraved medium accommodating part 3 and the engraved medium accommodating part 5 according to the present embodiment are formed into the same structure as mentioned above.

A device frame 15 is provided with side plates 17, 19, 21, 23, 25 for compartments. The side plates 17, 19, 21, 23, 25 are apart from each other at the same width and cassette accommodating parts 27, 29, 31, 33 at four locations in total are formed directly adjacently in the Y-direction. Widths for arrangement of upper face plates and the like of the side plates 21, 23 in the Y-direction are set for sensor attachment described later to be slightly wider than of the other side plates 17, 19, 25.

Namely, the side plates 17, 19, 21, 23, 25 are provided integrally with front face plates on the front side of the device and upper face plates on the upper side of the device and the widths of the front face plates and the upper face plates of the side plates 21, 23 in the Y-direction correspond to widths of spaces for sensor attachment.

The unengraved medium accommodating part 3 is provided with card cassettes 35, 37 detachably with one-touch operation in the cassette accommodating parts 27, 29. The engraved medium accommodating part 5 is provided with card cassette 39, 41 detachably with one-touch operation in the cassette accommodating parts 31, 33.

The card cassette 35, 37, 39, 41 basically have the same structured the card cassette 35 will be explained and explanation for the card cassette 37, 39, 41 will be omitted.

The card cassette 35 is one in which cassette side plates 45*a*, 45*b* are attached to a cassette base 43. To the cassette base 43, a handle 47 is attached on the front. An upper end of the card cassette 35 is open to allow cards to be put in and out. At inside lower ends of the cassette side plates 45*a*, 45*b*, a card receiving parts 49 are provided. On an outside upper side of the cassette side plates 45*a*, 45*b*, engaging protruding parts 51*a*,51*b* are provided so as to protrude on outer face sides of the cassette side plates 45*a*, 45*b*.

The engaging protruding parts 51*a*,51*b* are detachably stopped and locked by a stopping arm body 53 comprising a pair of arms. A shaft 53*a* in the middle of the stopping arm body 53 is rotatably attached between the side plates 17, 19. Between the stopping arm body 53 and the side plates 17, 19, a return spring 55 is attached to rotationally push the stopping arm body 53 in a stopping and locking direction. On the side plate 19 side, a releasing solenoid 57 is attached and is connected to the stopping arm body 53. Accordingly, when the stopping arm body 53 is rotated by the releasing solenoid 57 against the return spring 55, the stopping and locking of the engaging protruding parts 51*a*,51*b* due to the stopping arm body 53 is released, on the side plate 19 side, an interlock 59 is attached, to detachably lock a back on one side of the card cassette 35.

Accordingly, when the card cassette 35 is inserted from the front side of the device into the cassette accommodating part 27 between the side plates 17, 19, the engaging protruding parts 51*a*,51*b* come into contact with a front end of the stopping arm body 53 and the stopping arm body 53 rotates around the shaft 53*a* with further insertion so that the engaging protruding parts 51*a*,51*b* run over the front end of the stopping arm body 53 against the pushing force and then are stopped and locked. A lower side of the card cassette 35 is connected by the interlock 59. With these locking and connecting, the card cassette 35 is put in the cassette accommodating part 27. By being connected to the interlock 59, operation of a stepping motor and the like to vertically move a table explained later is allowed.

When driving the releasing solenoid 57 according to button operation or the like, the stopping and locking of the engaging protruding parts 51*a*,51*b* is released by rotation of the stopping arm body 53.

On a lower part of the cassette accommodating part 27, a carriage 61 is arranged. The carriage 61 supports a table 63 and the table 63 faces a lower end of the card cassette 35. The table 63 elevates in an inside of the card cassette 35 from the lower end of the card cassette 35 to lift the cards stacked and accommodated in the card receiving parts 49. With the lifting of the cards, a stacked uppermost card is arranged at an upper taking-out position in the card cassette 35.

To the carriage 61, a linear bush 65 and a ball socket 66 are fixedly attached. The linear bush 65 is fitted to a cassette shaft 67 so as to be vertically movably guided and the ball socket 66 engages with a ball screw 69.

A lower end of the cassette shaft 67 is fixedly attached to a motor attachment plate 71, and a lower end of the ball screw 69 is rotatably supported by the motor attachment plate 71 with a thrust needle roller bearing 73. An upper end of the cassette shaft 67 is fixedly attached to an upper plate 75 and an upper end of the ball screw 69 is rotatably supported by the upper plate 75 through a bearing 77.

The motor attachment plate 71 is fixed to the side plate 19. To the motor attachment plate 71, a stepping motor 79 is attached. Timing gears 81, 83 are attached to an output shaft of the stepping motor 79 and the lower end of the ball screw 69, and a timing belt 85 is wound around the timing gears 81, 83.

The ball socket 66 is vertically driven by driving of the ball screw 69 and the carriage 61 is vertically moved and guided along the cassette shaft 67.

To the upper plate 75, an air block 87 is pivotably supported with a nozzle shaft 89. Between a rear end of the air block 87 in the X-direction and the side plate 19, a tension spring 91 is interposed. The tension spring 91 biases the air block 87 so that a front end of the air block 87 in the X-direction is slightly oriented upward. To the front end of the air block 87, a pair of nozzles 92*a*, 92*b* are fixed. Air is injected from the nozzles 92*a*, 92*b* to allow the media dispenser 7 to take out cards one by one. To the nozzles 92*a*, 92*b*, an air pump 94 is connected to conduct injection of pulsing air from the nozzles 92*a*, 92*b*. With the injection of the air, a stuck lower card is separated.

It should be noted that arrangements of the unengraved medium accommodating parts 3 and the engraved medium accommodating parts 5 may be reversed in the Y-direction. The unengraved medium accommodating parts and the engraved medium accommodating parts may be configured so that the card cassette for the unengraved cards and the card cassette for the engraved cards are alternately arranged.

Figure 14:
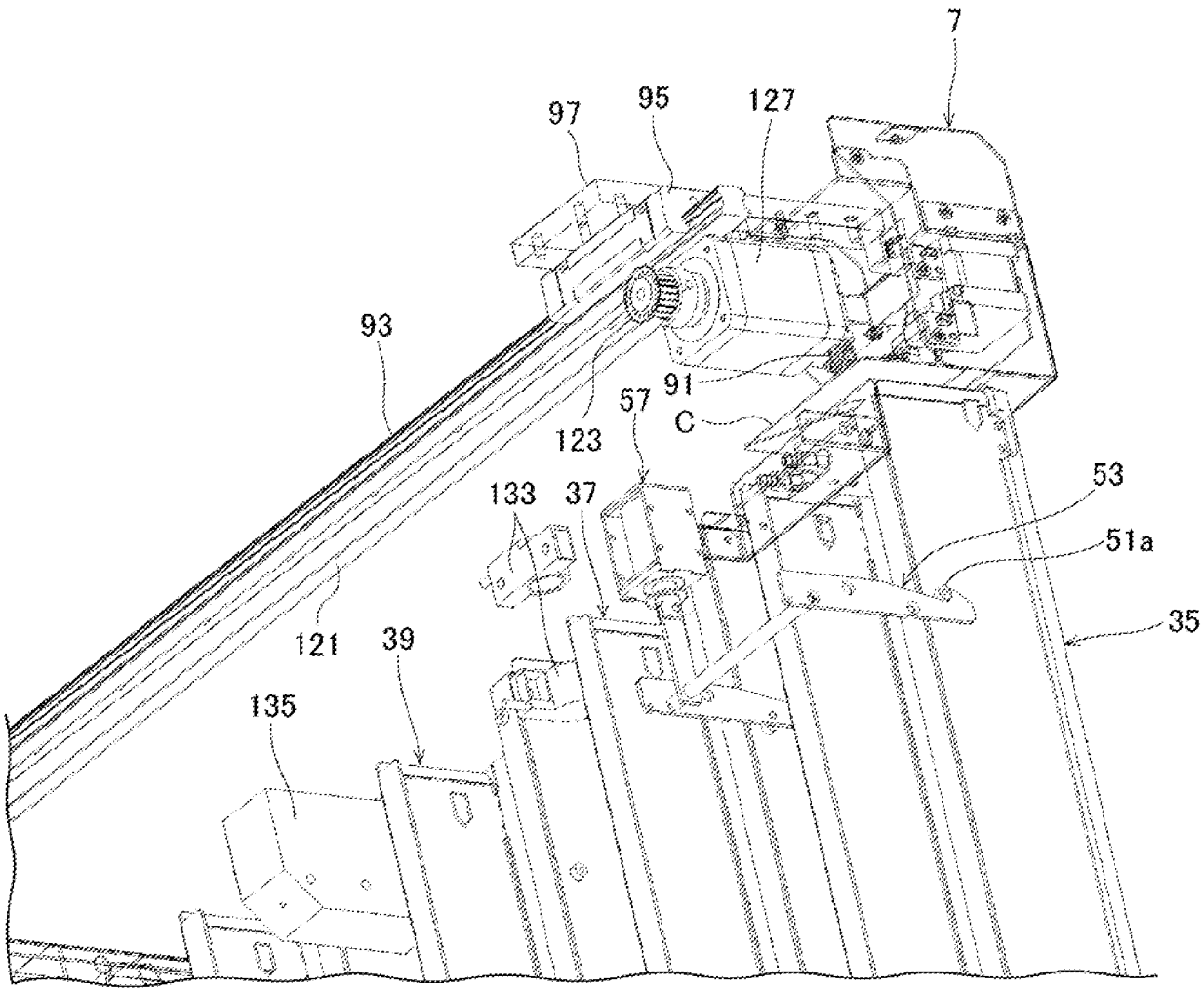
FIG. 14 is a fragmentary perspective view illustrating the medium dispenser relative to the card cassette when seen from the lower back side according to the Embodiment 1.
Figure 15:
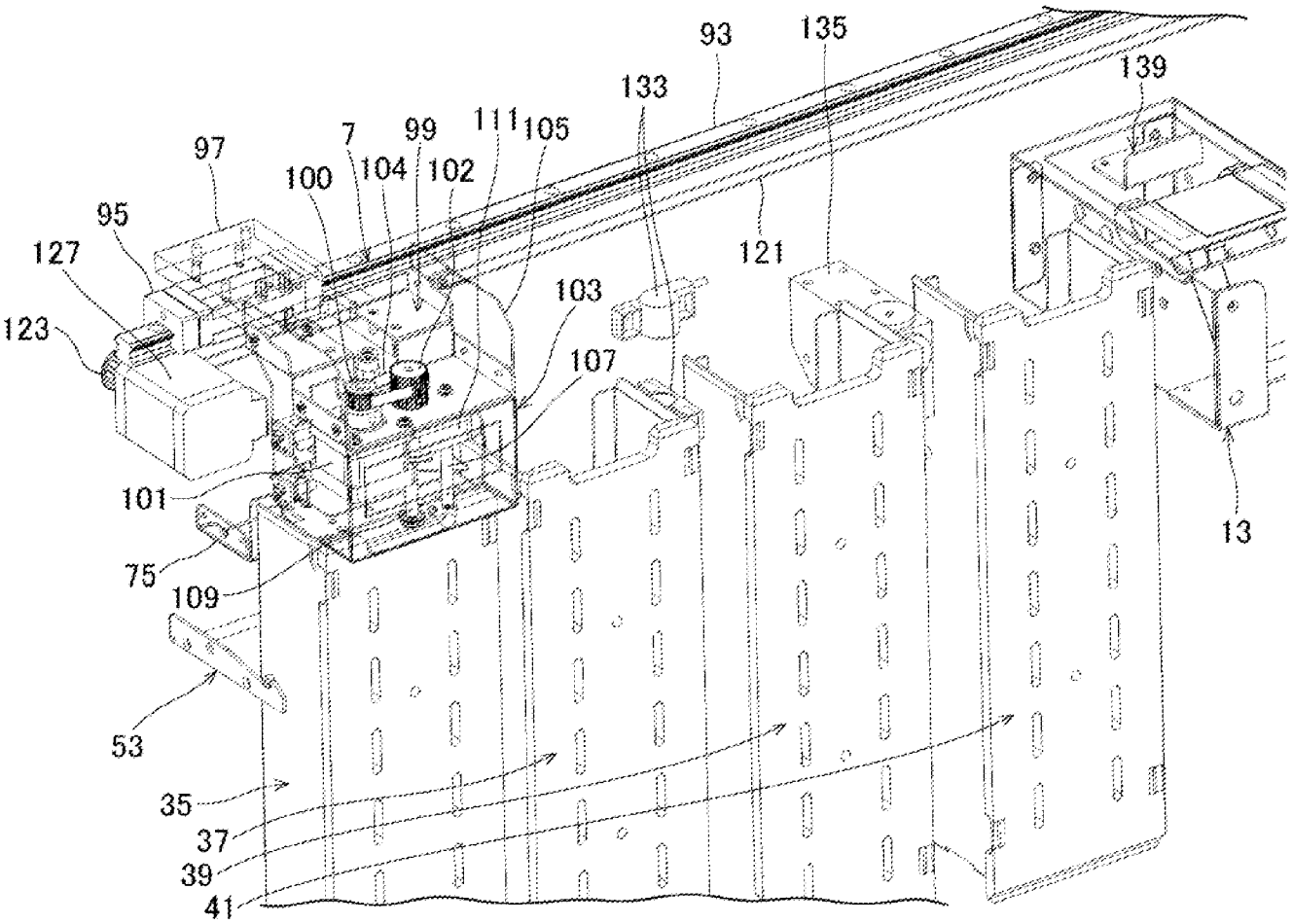
FIG. 15 is a fragmentary perspective view illustrating the medium dispenser relative to the card cassette when seen from an upper front side according to the Embodiment 1.

FIG. 14 is a fragmentary perspective view illustrating the medium dispenser relative to the card cassette when seen from the lower back side. FIG. 15 is a fragmentary perspective view illustrating the medium dispenser relative to the card cassette when seen from an upper front side.

As illustrated in FIGS. 5-10, 14, 15, the medium dispenser 7 is arranged above the card cassette 35 in a position of the drawings and is supported with a guide rail 93 to be allowed to travel. The medium dispenser 7 is reciprocatively traveled and guided along the guide rail 93 in the Y-direction. The guide rail 93 is attached to the device frame 15 along the Y-direction.

A guide block 95 is attached to the guide rail 93 so that the guide block 95 is guided along the guide rail 93.

A Y-axis base 97 is attached to the guide block 95 and a Y-axis motor base 99 is attached to the Y-axis base 97. To the Y-axis motor base 99, a stepping motor 101 is attached and a Y-axis cover 103 and a Y-axis elevation guide 105 are supported.

Between the Y-axis motor base 99 and the Y-axis elevation guide 105, a sliding shaft 107 and a ball screw 109 are supported.

An elevation block 111 is arranged on a lower part side of the Y-axis motor base 99, and the elevation block 111 is connected to the sliding shaft 107 through a linear bush to be guided and is connected to the same ball screw 109 through the ball socket to be vertically driven.

Timing gears 100, 102 are attached to an output shaft of the stepping motor 101 and the ball screw 109 on the Y-axis motor base 99 and a timing belt 104 is wound between the timing gears 100, 102.

The ball screw 109 is, therefore, interlocked with driving of the stepping motor 101 to vertically drive the elevation block 111.

A pad nozzle 113 is supported with the elevation block 111, is oriented downwardly and faces an upper part of the card cassette 35. A coil spring is mounted outside the pad nozzle 113 and a front end of the pad nozzle 113 is allowed to be elastically contact with a card at the upper part of the card cassette 35.

A vacuum pump 115 is connected to the pad nozzle 113 is connected so that the pad nozzle 113 adsorbs a card at the upper part of the card cassette 35 or releases an adsorbed card.

A harness slide plate 117 is attached to the guide block 95, and a timing belt metal fitting 119 is attached to the harness slide plate 117. The timing belt metal fitting 119 is connected to a timing belt 121. The timing belt 121 is wound between timing gears 123, 125. The timing gear 123 is attached to an output shaft of a stepping motor 127, and the timing gear 125 is supported with an end of the device frame 15. The stepping motor 127 is fixed on the device frame 15 side.

Accordingly, the timing belt 121 is driven along the guide rail 93 according to driving of the stepping motor 127, and the guide block 95 moves along the guide rail 93 through the timing belt metal fitting 119. When the guide block 95 moves, the media dispenser 7 travels through the Y-axis base 97 along the Y-direction. Through such traveling, the media dispenser 7 is reciprocated along the guide rail 93 and stopped in the middle. This traveling and stopping control is performed by a program installed in advance. The media dispenser 7 may be manually traveled using manual buttons or the like.

The harness slide plate 117 supports an end of a cable 129, and the other end of the cable 129 is supported with a cable guide 131 attached on the device frame 15 side. When the media dispenser 7 performs reciprocative operation, the cable 129 is folded on the cable guide 131 or developed from the cable guide 131. The cable 129 is for power supply to each part such as the motor.

As illustrated in FIGS. 1, 3, 5, sonic sensors 133 are arranged between the cassette accommodating parts 29, 31 using a space. One of the sonic sensors 133 is fixed to the device frame 15, and the other thereof is attached to the upper face plate of the side plate 21. To the upper face plate of the side plate 21, a hole for the sonic sensor 133 is formed.

The sonic sensor 133 is used to detect whether a card adsorbed and conveyed by the medium dispenser 7 is a single sheet and discharging process is performed by the pre-positioning part 13 if a plurality of cards are simultaneously conveyed.

A color sensor 135 is arranged between the cassette accommodating parts 31, 33 using a space. The color sensor 135 is attached to the upper face plate of the side plate 23. To the upper face plate of the side plate 23, a hole for the color sensor 135 is formed.

The color sensor 135 is used to detect true or false of a front and back of a card adsorbed and conveyed by the medium dispenser 7, and discharging process is performed by the pre-positioning part 13 if the front and back of the card adsorbed and conveyed by the medium dispenser 7 is false.

Figure 16:
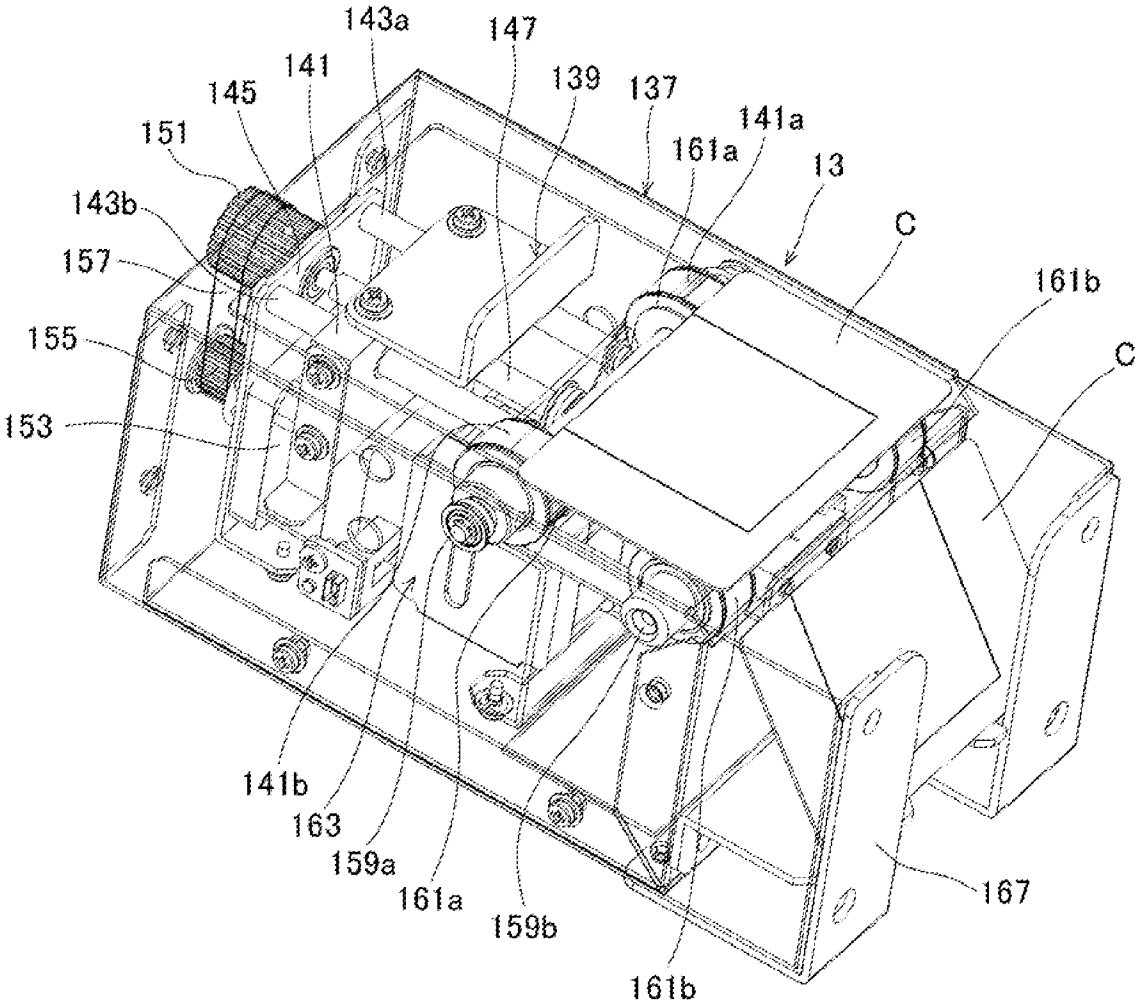
FIG. 16 is a perspective view illustrating the pre-positioning part with partial transparency according to the Embodiment 1.
Figure 17:
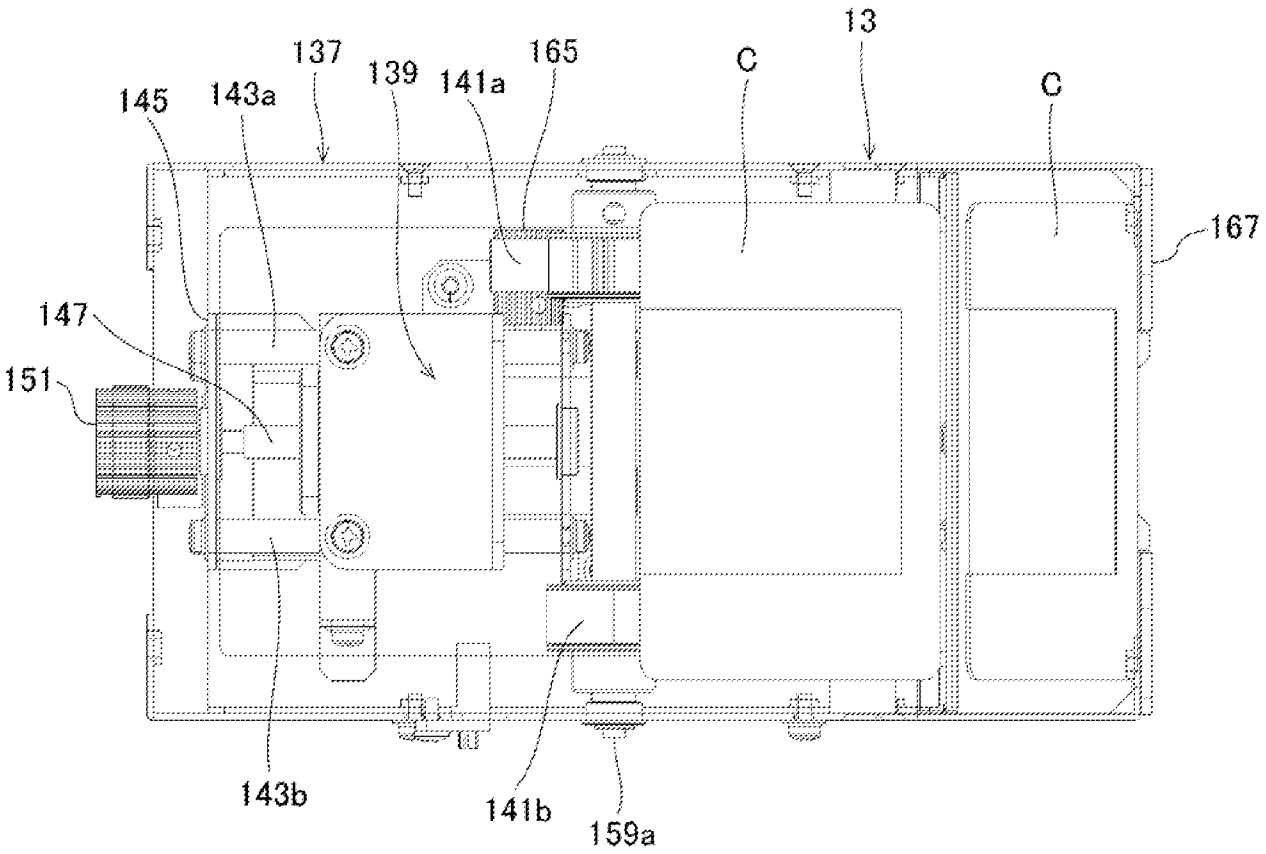
FIG. 17 is a plan view illustrating the pre-positioning part with partial transparency according to the Embodiment 1.
Figure 18:
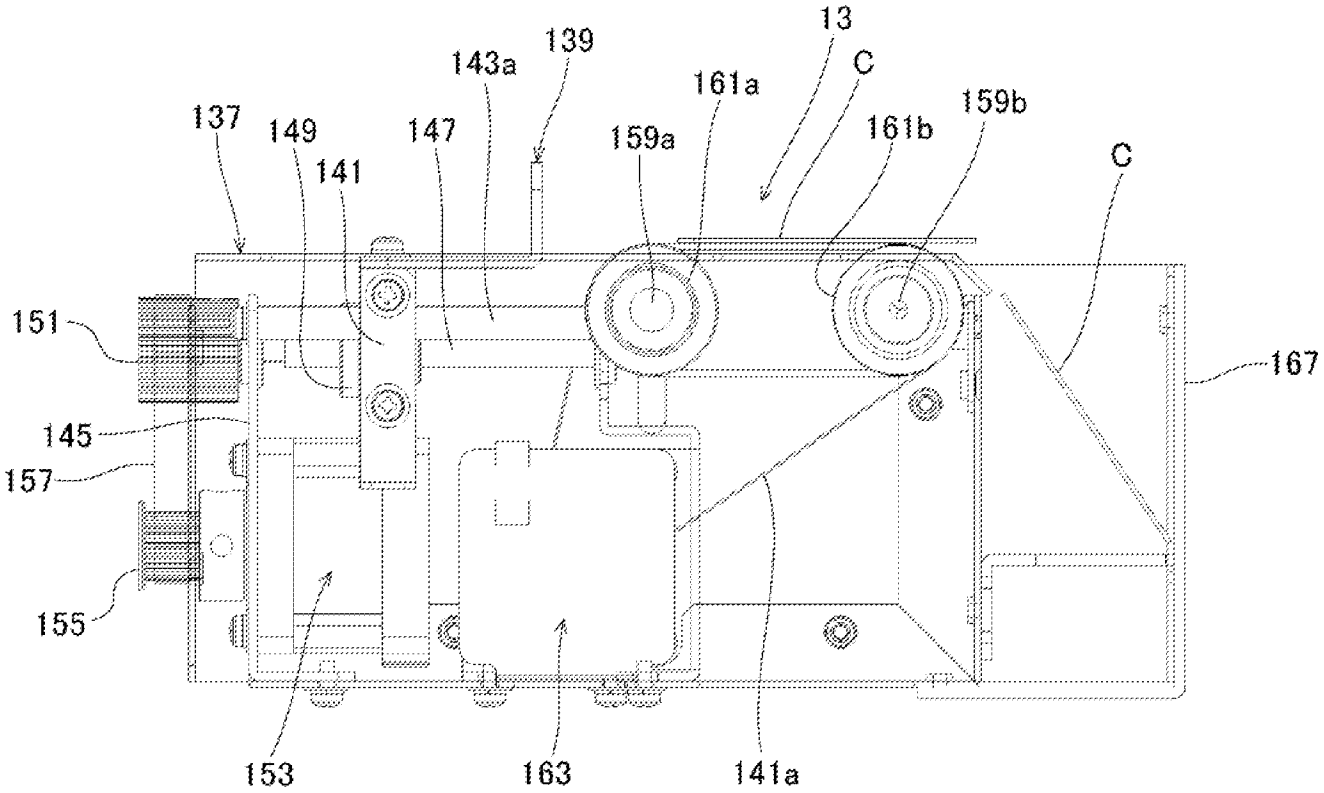
FIG. 18 is a sectional view illustrating the pre-positioning part sectioned with an XY plane according to the Embodiment 1.
Figure 19:
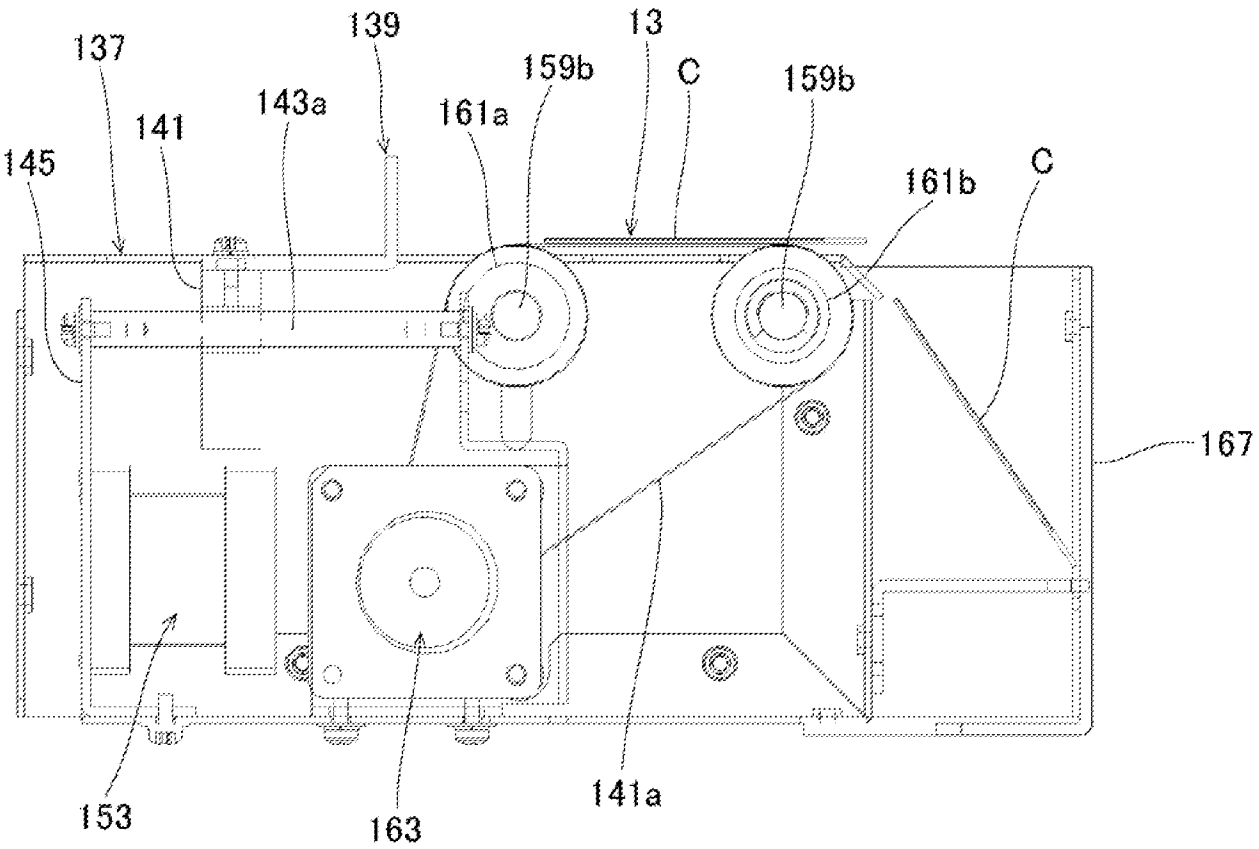
FIG. 19 is a sectional view illustrating the pre-positioning part sectioned with a different XY plane according to the Embodiment 1.
Figure 20:
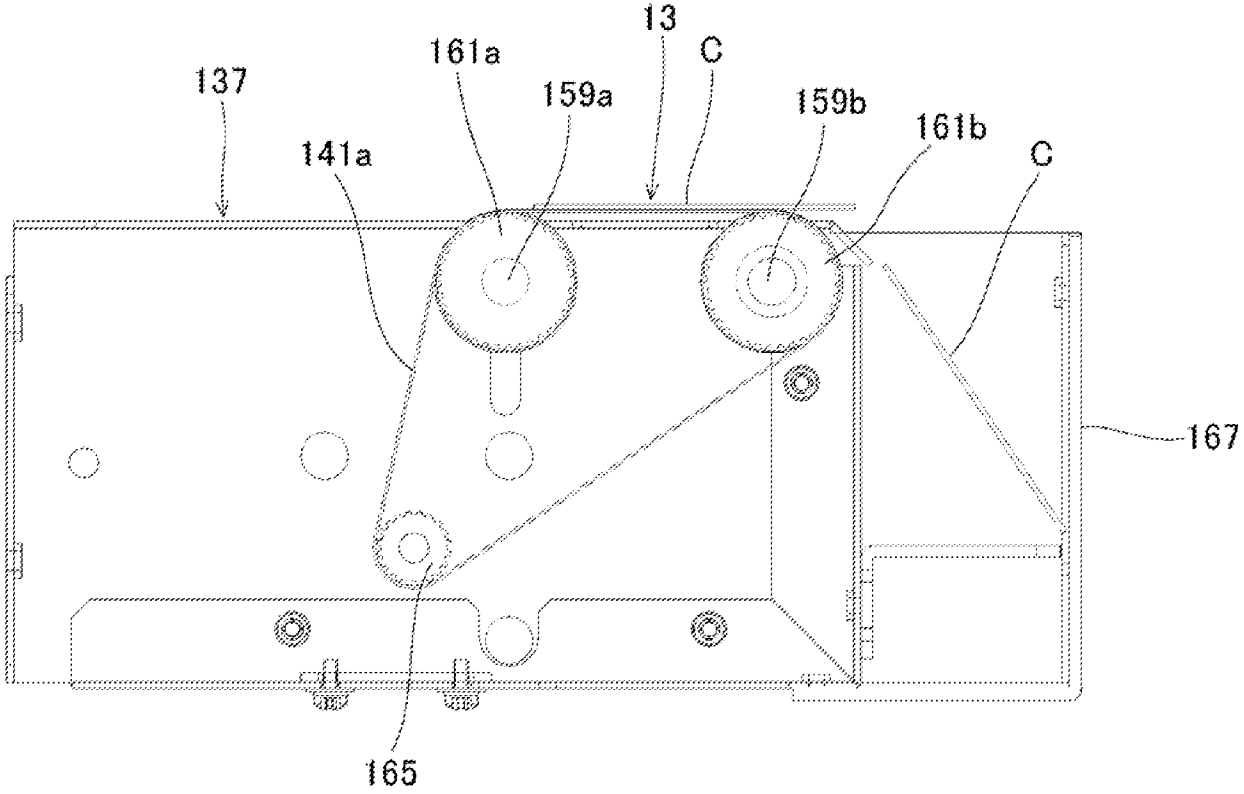
FIG. 20 is a sectional view illustrating the pre-positioning part sectioned with a still different XY plane according to the Embodiment 1.

FIG. 16 is a perspective view illustrating the pre-positioning part with partial transparency. FIG. 17 is a plan view illustrating the pre-positioning part with partial transparency. FIG. 18 is a sectional view illustrating the pre-positioning part sectioned with an XY plane. FIG. 19 is a sectional view illustrating the pre-positioning part sectioned with a different XY plane. FIG. 20 is a sectional view illustrating the pre-positioning part sectioned with a different XY plane.

As illustrated in FIGS. 1, 3, 5, 16-20, the pre-positioning part 13 is arranged adjacent to the side plate 25 of the engraved medium accommodating part 5.

The pre-positioning part 13 has a structure in which a case-shaped alignment traveling base 137 with an upper opening is provided mainly with a stopper plate 139 and belts 141*a*, 141*b*.

The stopper plate 139 is formed into an L-shaped cross section and is arranged so that a positioning face is oriented in the X-direction. An alignment block 141 is attached to a lower face of the stopper plate 139 and is fitted to a pair of sliding shafts 143*a*, 143*b* to be slidably guided. The sliding shafts 143*a*, 143*b* are fixedly supported with an alignment base 145. The alignment base 145 is fixed to the alignment traveling base 137.

A ball screw 147 is rotatably supported with the alignment base 145. A ball socket 149 is fitted to the ball screw 147, and the ball socket 149 is fixed to the alignment block 141.

The alignment block 141, therefore, moves in the X-direction according to rotationally driving of the ball screw 147, and an alignment position using the stopper plate 139 is determined. Positioning of the card in the X-direction is performed at the alignment position of the stopper plate 139 determined in advance.

A timing gear 151 is attached to the ball screw 147 outside the alignment traveling base 137. A timing gear 155 is attached to an output shaft of a stepping motor 153. A timing belt 157 is wound between the timing gears 151, 155.

The ball screw 147 is, therefore, normally and reversely driven through the timing belt 157 according to driving of the stepping motor 153.

Aligner driving shafts 159*a*, 159*b* are attached to the alignment traveling base 137 on a near side in the X-direction and oriented toward the Y-direct on. Respective pairs of timing gears 161*a*, 161*b* are attached to the aligner driving shafts 159*a*, 159*b*, respectively. A stepping motor 163 is attached to the alignment traveling base 137 on a bottom side and a timing gear 165 is attached to an output shaft of the motor on the belt 141*a* side. The belt 141*a* is wound among the timing gears 161*a*, 161*b*, 165 and the belt 141*b* is wound between the timing gears 161*a*, 161*b*.

On one side of the alignment traveling base 137, a discharging tray 167 is provided on a discharging side that is a near side of the belts 141*a*, 141*b* in the X-direction.

Accordingly, when the card C conveyed by the medium dispenser 7 is transferred on the belts 141*a*, 141*b* and when the belt 141*a* is driven to run toward the stopper plate 139 that is a back side in the X-direction by driving of the stepping motor 163, the belt 141*b* is synchronized through the aligner driving shafts 159*a*, 159*b* and the like to be driven to run in the same direction. With this driving, the card C is brought into contact with the stopper plate 139 and positioned in the X-direction. Positioning of the card C in the Y-direction is a position at which the adsorption is performed by the medium dispenser 7.

If two cards C conveyed by the medium dispenser 7 are put one on another or a front and back of the card is false, the stepping motor 163 is driven in a reverse direction when the card or cards C are transferred on the belts 141*a*, 141*b*. With this driving, the belts 141*a*, 141*b* are driven to run in a discharging direction and the card or cards C are discharged to the discharging tray 167, thereby to prevent a wasteful incorrect image engraving at the image engraving part 11.

As illustrated in FIGS. 1, 3, 5, the medium positioning and conveying part 9 and the image engraving part 11 are arranged adjacent to the pre-positioning part 13.

The medium positioning and conveying part 9 is provided with a blank setting platform 175. The blank setting platform 175 is supported with a shaft through a slider of a Y-axis driving mechanism and is configured to be reciprocatively driven in the Y-direction. At the time of image engraving, the card C is adsorbed and supported with an adsorbing part 177 of the blank setting platform 175. The blank setting platform 175 reciprocatively moves in the Y-direction within a small range at the engraving position EGP at the time of the engraving, to perform the programmed image engraving on the card C in cooperation with engraving motions of an engraving stylus 171*a* in X-, Z-directions.

Further, the blank setting platform 175 is reciprocatively travelable between the engraving position EGP and the succeeding position TOP according to control.

The adsorbing part 177 is a mechanism to conduct adsorption through fine holes of a porous planar member, and a vacuum pump is connected on the porous planar member side through a solenoid valve. The adsorption is performed through the fine holes of the porous planar member by operation of the vacuum pump to adsorb and fix the card on the porous planar member with good adhesiveness.

At this time, a pressure state capable of engraving, for example, 50 KPa or over is set according to pressure detection of a pressure switch, whereby a state in which a medium to be engraved has no swelling, no deviation and the like is detected to know an adhesion state at an accurate position at which an engraving can be performed. With this pressure detection, an engraving head 173 and the like may be automatically operated. A value of 50 KPa or over of the pressure state is experimentally found as one capable of detecting that a medium to be engraved has no swelling, no deviation and the like.

The image engraving part 11 is provided with a mechanism base 169 supported on the device frame 15 side. The engraving head 173 supporting an oscillation generating part 171 is arranged on the mechanism base 169.

The engraving head 173 is interlocked with an X-axis driving mechanism and a Z-axis driving mechanism and is controlled to be reciprocatively driven in the X-direction and the Z-direction.

The oscillation generating part 171 of the engraving head 173 has an electromagnet side being floatingly supported with a spring relative to a permanent magnet side and the electromagnet side finely swings and vibrates according to working between the permanent magnet side and the electromagnet side and an action of the spring.

With this finely vibrating, switching of energization to a coil is performed based on an engraving signal, thereby to oscillate the engraving stylus 171*a* based on a signal that is an electric signal converted from image data and move the engraving head 173 in the X-direction, the Z-direction, to perform a finely engraving on the surface of the card C as well as the movement of the blank setting platform 175 in the Y-direction.

Unengraved cards are accommodated in the card cassette 35, 37 in advance.

Driving of each part is automatically controlled according to a program of a controlling part and is operated by turning a starting switch ON.

In the medium dispenser 7, the pad nozzle 113 descends according to the driving of the stepping motor 101 and the pad nozzle 113 adsorbs the highest card in the card cassette 35. The pad nozzle 113 ascends up to a predetermined position according to return of the driving of the stepping motor 101 while adsorbing the card C.

When the pad nozzle 113 ascends while adsorbing the card C, in the middle thereof air is injected from the nozzles 92*a*, 92*b* so as to be pulsed and blows against the card. With this blowing of the air, even if a lower card is, for example, adhered to the card C adsorbed by the pad nozzle 113 and is lifted together, the lower card is separated to be fallen down and the card C adsorbed by the pad nozzle 113 is a single sheet.

Accordingly, taking out the cards one by one with the media dispenser 7 is accurately performed and continuous engravings are smoothly conducted.

Next, the timing belt 121 is driven along the guide rail 93 according to the driving of the stepping motor 127 so that the medium dispenser 7 travels to the pre-positioning part 13 in the Y-direction.

On the other hand, when the card C is taken out from the card cassette 35, the stepping motor 101 is driven based on detection of the sensor and the table 63 ascends through the carriage 61 so that a highest card stands by at the taking-out position.

In the middle of the traveling of the medium dispenser 7 to the pre-positioning part 13, the controlling part determines whether the card C adsorbed and conveyed by the medium dispenser 7 is a single sheet or not according to the detection of the sonic sensors 133 and the controlling part determines which the front and back of the card C adsorbed and conveyed by the medium dispenser 7 is correct or false according to the detection of the color sensor 135.

The medium dispenser 7 stops above the belts 141*a*, 141*b* after traveling to the pre-positioning part 13 in the Y-direction.

The medium dispenser 7 descends the pad nozzle 113 and releases the adsorption of the card C by means of the pad nozzle 113 above the belts 141*a*, 141*b* of the pre-positioning part 13 so that the card C is succeeded on the pre-positioning part 13.

The card C succeeded and transferred on the pre-positioned part 13 is put on the belts 141*a*, 141*b* so as to bridge therebetween.

If the determination result of whether the card C is a single sheet and the determination result of correct or false of the front and back of the card C are correct, the belts 141*a*, 141*b* runs in the stopper plate 139 direction according to the driving of the stepping motor 163 and a side of the card C comes into contact with the stopper plate 139 to be positioned in the X-direction.

The image engraving at the image engraving part 11, therefore, is performed on a correct position of the card.

In addition, though the positioning of the card C in the Y-direction is a position at which it is adsorbed by the medium dispenser 7, positioning metallic parts may be arranged around the adsorbing part 177 of the blank setting platform 175, the card C may be slightly moved in the Y-direction according to slight movement of the medium dispenser 7 when the card C is arranged on the adsorbing part 177, and the card may be positioned by, for example, bringing the same into contact with the metallic parts. At the time of this positioning, bending of the pad nozzle 113 may be used to allow the card C to be brought into contact with the metallic parts.

If the determination result of whether the card C is a single sheet and the determination result of correct or false of the front and back of the card C are false, the belts 141*a*, 141*b* run in an inverse stopper plate 139 direction according to the reversely driving of the stepping motor 163 to discharge the card C to the discharging tray 167.

The engravings are, therefore, correctly performed on the cards in the continuous engraving operations.

After the positioning on the pre-positioning part 13 in the X-direction, the medium dispenser 7 standing by at an upper position descends the pad nozzle 113 to adsorb the card C after the positioning.

The medium dispenser 7 adsorbing the card C travels in the Y-direction according to the driving of the stepping motor 127 and stops above the blank setting platform 175 standing by on the succeeding position TOP.

The medium dispenser 7 descends the pad nozzle 113 and releases the adsorption of the card C by means of the pad nozzle 113 above the succeeding position TOP so that the card C is succeeded to the blank setting platform 175 of the medium positioning and conveying part 9.

The card C succeeded to the blank setting platform 175 is fixed to the blank setting platform 175 by the adsorption with the adsorbing part 177.

The blank setting platform 175 succeeding the card C travels to the engraving position EGP so that the image engraving is performed by the engraving stylus 171*a* on the card C according to the image signal from the controlling part.

Next, the medium dispenser 7 returns back to the card cassette 35 in the Y-direction, adsorbs the highest card and transfers the same to the pre-positioning part 13 similarly to the above to perform the positioning of the unengraved card on the pre-positioning part 13.

At this time, the engraved antecedent card C that is engraved at the engraving position EGP returns back to the succeeding position TOP according to the traveling of the blank setting platform 175.

The medium dispenser 7 standing by above the pre-positioning part 13 travels to the succeeding position TOP, adsorbs the engraved card C at the succeeding position TOP, and returns back to the card cassette 39 of the engraved medium accommodating part 5 in the Y-direction.

The medium dispenser 7 releases the adsorption of the engraved card C by means of the pad nozzle 113 above the card cassette 39, to transfer the card on the table of the card cassette 39. The transferring of the card on the table is detected by the sensor, the stepping motor is driven to descend the table through the carriage in order to allow a next engraved card to be transferred.

The medium dispenser 7 releasing the engraved card C moves to the pre-positioning part 13, adsorbs the unengraved card standing by on the pre-positioning part 13 similarly to the above, and the card C is transferred to the blank setting platform 175 standing by at the succeeding position TOP.

Next, the medium dispenser 7 returns back to the card cassette 35 in the Y-direction to absorb the highest card and transfer the same to the pre-positioning part 13 similarly to the above to position the unengraved card. C.

With repetition of the operation, the unengraved cards in the card cassette 35 of the unengraved medium accommodating part 3 are sequentially engraved and accommodated in the card cassette 39 of the engraved medium accommodating part 5.

After completing the engravings of the cards in the card cassette 35, the unengraved cards in the card cassette 37 of the unengraved medium accommodating part 3 are engraved through taking-out of the same as mentioned above and sequentially accommodated in the card cassette 41 of the engraved medium accommodating part 5.

Such a sequential operation may be terminated by the engravings through the taking-out of the cards in the card cassette 35, and may perform the engravings through the taking-out of the cards in the card cassette 37 without using the card cassette 35.

The engraved cards may be accommodated by using any one of the card cassette 39, 41 of the engraved medium accommodating part 5 only.

Since the medium dispenser 7 is reciprocatively traveled in the Y-direction, thereby to take out the unengraved card, position the same, support the same with the blank setting platform 175, and accommodate the engraved card, the smooth engraving operation is performed as a whole.

The guide rail 93 and the timing belt 121 are also linearly arranged to simplify the structure.

The unengraved medium accommodating part 3, the engraved medium accommodating part 5, the pre-positioning part 13, the medium positioning and conveying part 9 and the image engraving part 11 are linearly arranged in line in the Y-direction, thereby making the device compact wholly. Accordingly, this enables the installing space of the device to be compact. Accordingly, this enables the installing space of the device to be compact.

The cards are vertically stacked with respect to the unengraved medium accommodating part 3 and the engraved medium accommodating part 5, thereby to suppress increasing in size of the device.

The vertically stacked unengraved cards stand by at the taking-out position according to the vertically driving of the table and this smoothly conducts the adsorption and taking-out by means of the medium dispenser 7.

The accommodating of the engraved cards relative to the engraved medium accommodating part 5 succeeds to and accommodates the card at the appropriate vertical position according to the vertically driving of the table, to conduct the smooth accommodating operation.

Since the pre-positioning part 13 is provided between the unengraved medium accommodating part 3 and the engraved medium accommodating part 5 and the medium positioning and conveying part 9, the unengraved card C is positioned at the pre-positioning part 13 and thereafter is succeeded to the blank setting platform 175 of the medium positioning and conveying part 9 at the succeeding position TOP, and the engraved car C at the succeeding position TOP is moved above the engraved medium accommodating part 5 during the unengraved card C is positioned at the pre-positioning part 13.

Accordingly, the standing-by of the unengraved card C for the next engraving and the taking-out of the engraved card C are performed while overlapping conveyance paths to improve work efficiency.

The invention claimed is:

1. An automatic continuous image engraving device comprising:

an unengraved medium accommodating part that accommodates unengraved card-shaped engraving media vertically stacked;

an engraved medium accommodating part that is arranged adjacent to the unengraved medium accommodating part and accommodates engraved card-shaped engraving media;

a medium dispenser that adsorbs a highest one of the stacked unengraved card-shaped engraving media from an upper part of the unengraved medium accommodating part, moves the highest one to an outside of a region above the unengraved medium accommodating part and linearly travels in an adjacent direction of the unengraved medium accommodating part and the engraved medium accommodating part;

a medium positioning and conveying part arranged in a traveling direction of the medium dispenser and configured to succeed to the unengraved card-shaped engraving medium at a succeeding position, move the unengraved card-shaped engraving medium, and position the unengraved card-shaped engraving medium at an engraving position;

an image engraving part arranged at the engraving position to perform image engraving on the unengraved card-shaped engraving medium at the engraving position, wherein the medium dispenser releases the unengraved card-shaped engraving medium to cause the unengraved card-shaped engraving medium to be succeeded at the succeeding position, the medium positioning and conveying part returns the engraved card-shaped engraving medium after image engraving from the engraving position to the succeeding position, and the medium dispenser adsorbs the engraved card-shaped engraving medium at the succeeding position, moves the engraved card-shaped engraving medium upward, travels above the engraved medium accommodating part, and releases the engraved card-shaped engraving medium to be accommodated.

2. The automatic continuous image engraving device according to claim 1, wherein the unengraved medium accommodating part is provided with a table on which the unengraved card-shaped engraving media vertically stacked are put, the table that is vertically driven, the highest one of the unengraved card-shaped engraving media is put to a predetermined vertical position by vertically driving of the table, and the medium dispenser adsorbs the highest unengraved card-shaped engraving medium at the predetermined vertical position.

3. The automatic continuous image engraving device according to claim 2, further comprising:

a pre-positioning part provided between the medium positioning and conveying part and the unengraved medium accommodating part and the engraved medium accommodating part to pre-position an unengraved card-shaped engraving medium, wherein the medium dispenser positions the unengraved card-shaped engraving medium at the pre-positioning part and then causes the medium positioning and conveying part to succeed to the unengraved card-shaped engraving medium at the succeeding position, and moves an engraved card-shaped engraving medium at the succeeding position above the engraved medium accommodating part during the unengraved card-shaped engraving medium is positioned at the pre-positioning part.

4. The automatic continuous image engraving device according to claim 1, further comprising:

a pre-positioning part provided between the medium positioning and conveying part and the unengraved medium accommodating part and the engraved medium accommodating part to pre-position an unengraved card-shaped engraving medium, wherein the medium dispenser positions the unengraved card-shaped engraving medium at the pre-positioning part and then causes the medium positioning and conveying part to succeed to the unengraved card-shaped engraving medium at the succeeding position, and moves an engraved card-shaped engraving medium at the succeeding position above the engraved medium accommodating part during the unengraved card-shaped engraving medium is positioned at the pre-positioning part.

* * * * *